US011448012B2

(12) United States Patent
Huang et al.

(10) Patent No.: US 11,448,012 B2
(45) Date of Patent: Sep. 20, 2022

(54) WINDOW SHADE AND SPRING DRIVE SYSTEM THEREOF

(71) Applicant: TEH YOR CO., LTD., New Taipei (TW)

(72) Inventors: Chin-Tien Huang, New Taipei (TW); Chien-Fong Huang, City of Industry, CA (US)

(73) Assignee: TEH YOR CO., LTD., New Taipei (TW)

( * ) Notice: Subject to any disclaimer, the term of this patent is extended or adjusted under 35 U.S.C. 154(b) by 709 days.

(21) Appl. No.: 16/139,812

(22) Filed: Sep. 24, 2018

(65) Prior Publication Data

US 2019/0093426 A1 Mar. 28, 2019

Related U.S. Application Data

(60) Provisional application No. 62/562,555, filed on Sep. 25, 2017.

(51) Int. Cl.
*E06B 9/262* (2006.01)
*E06B 9/60* (2006.01)
(Continued)

(52) U.S. Cl.
CPC ..... *E06B 9/60* (2013.01); *E06B 9/262* (2013.01); *E06B 9/322* (2013.01); *E06B 9/78* (2013.01); *E06B 2009/2625* (2013.01)

(58) Field of Classification Search
CPC ..... E06B 2009/3222; E06B 9/60; E06B 9/322
See application file for complete search history.

(56) References Cited

U.S. PATENT DOCUMENTS 6,283,192 B1 * 9/2001 Toti ..... E06B 9/30 160/170
6,761,203 B1 * 7/2004 Huang ..... E06B 9/322 160/170
(Continued)

FOREIGN PATENT DOCUMENTS

CN 2698208 Y 5/2005
CN 201024877 Y 2/2008
(Continued)

OTHER PUBLICATIONS

International Search Report & Written Opinion issued by the International Searching Authority on Jan. 11, 2019 in connection with PCT/US2018/052417.
(Continued)

*Primary Examiner* — Daniel P Cahn
*Assistant Examiner* — Jeremy C Ramsey
(74) *Attorney, Agent, or Firm* — Chen Yoshimura LLP

(57) ABSTRACT

A spring drive system for a window shade includes a housing, a cord drum and a first gear fixedly connected with each other and pivotally connected with the housing, the cord drum being connected with two second suspension cords, a second gear pivotally connected with the housing, two spring reels respectively pivotally connected at two opposite sides of the second gear so that the two spring reels are respectively rotatable relative to the second gear, the second gear and the two spring reels being disposed in a coaxial manner, a third gear pivotally connected with the housing and respectively meshed with the first and second gears, the third gear being fixedly connected with two second take-up reel at two opposite sides, and two springs each assembled around one corresponding spring reel and having one end connected with one corresponding take-up reel.

15 Claims, 20 Drawing Sheets

(51) Int. Cl.
*E06B 9/322* (2006.01)
*E06B 9/78* (2006.01)

(56) References Cited

U.S. PATENT DOCUMENTS

| | | | | |
|---|---|---|---|---|
| 2005/0072635 | A1* | 4/2005 | Toti | E06B 9/322 185/10 |
| 2006/0096719 | A1 | 5/2006 | Wu | |
| 2006/0144527 | A1* | 7/2006 | Toti | E06B 9/90 160/170 |
| 2010/0319860 | A1* | 12/2010 | DeWard | E06B 9/323 160/315 |
| 2012/0032019 | A1* | 2/2012 | Chen | E06B 9/322 242/378 |
| 2012/0061502 | A1* | 3/2012 | Chen | E06B 9/322 242/372 |
| 2014/0224431 | A1* | 8/2014 | Lin | E06B 9/262 160/84.01 |
| 2016/0123071 | A1* | 5/2016 | Huang | E06B 9/322 160/170 |
| 2016/0340975 | A1 | 11/2016 | Huang | |
| 2017/0016274 | A1* | 1/2017 | Zheng | E06B 9/304 |
| 2017/0067288 | A1* | 3/2017 | Nien | E06B 9/322 |
| 2017/0204656 | A1* | 7/2017 | Chen | E06B 9/322 |
| 2018/0119490 | A1* | 5/2018 | Chen | E06B 9/42 |
| 2018/0230739 | A1* | 8/2018 | Huang | E06B 9/262 |
| 2018/0230744 | A1* | 8/2018 | Huang | E06B 9/322 |
| 2018/0313143 | A1* | 11/2018 | Chang | E06B 9/322 |
| 2020/0399955 | A1* | 12/2020 | Chen | E06B 9/327 |
| 2021/0025227 | A1* | 1/2021 | Liu | B65H 75/486 |

FOREIGN PATENT DOCUMENTS

| | | | |
|---|---|---|---|
| CN | 102048438 | A | 5/2011 |
| CN | 204049181 | U | 12/2014 |
| CN | 105569540 | B | 9/2017 |
| TW | M247687 | U | 10/2004 |
| TW | 201814145 | A | 4/2018 |

OTHER PUBLICATIONS

Chinese Office Action, dated Jan. 9, 2020, and Search Report dated Dec. 31, 2019, in a counterpart Chinese patent application, No. CN 201811119297.8.

* cited by examiner

200

200

200A

200B

WINDOW SHADE AND SPRING DRIVE SYSTEM THEREOF

CROSS-REFERENCE TO RELATED APPLICATION(S)

This application claims priority to U.S. Provisional Patent Application No. 62/562,555 filed on Sep. 25, 2017, the disclosure of which is incorporated herein by reference.

BACKGROUND

1. Field of the Invention

The present invention relates to window shades, and spring drive systems used in window shades.

2. Description of the Related Art

Many types of window shades are currently available on the market, such as Venetian blinds, roller shades and honeycomb shades. The shade when lowered can cover the area of the window frame, which can reduce the amount of light entering the room through the window and provided increased privacy. Conventionally, the window shade is provided with an operating cord that can be manually actuated to raise or lower a bottom rail of the window shade. The bottom rail can be raised by winding a suspension member around a rotary drum, and lowered by unwinding the suspension member from the rotary drum.

However, there have been concerns that the operating cord of the window shade may pose strangulation risks to children. As a result, cordless window shades have been developed, which use electric motors or spring motors to raise and lower the bottom rail. Spring motors used in window shades generally consist of springs that are operable to apply a torque for keeping the bottom rail at a desired height. However, the conventional constructions of the spring motors are usually complex, and may not easily adapted to different sizes or types of window shades.

Therefore, there is a need for an improved spring drive system that can be conveniently used in window shades and address at least the foregoing issues.

SUMMARY

The present application describes a window shade and a spring drive system for use with the window shade. In one embodiment, the spring drive system includes a housing, a cord drum and a first gear fixedly connected with each other and pivotally connected with the housing, the cord drum being respectively connected with a first and a second suspension cord, a second gear pivotally connected with the housing, a first and a second spring reel respectively pivotally connected at two opposite sides of the second gear so that the first and second spring reels are respectively rotatable relative to the second gear, the second gear and the first and second spring reels being disposed in a coaxial manner, a third gear pivotally connected with the housing and respectively meshed with the first and second gears, the third gear being respectively connected fixedly with a first and a second take-up reel at two opposite sides of the third gear, a first spring disposed around the first spring reel and having an end anchored with the first take-up reel, and a second spring disposed around the second spring reel and having an end anchored the second take-up reel. The first and second springs can respectively unwind from the first and second spring reels and respectively wind around the first and second take-up reels when the cord drum rotates for unwinding the first and second suspension cords, and the first and second springs can respectively unwind from the first and second take-up reels and respectively wind around the first and second spring reels to urge the cord drum in rotation for winding the first and second suspension cords.

Moreover, the application describes different types of window shades that incorporate the spring drive system.

DETAILED DESCRIPTION OF THE EMBODIMENTS

Figure 1:
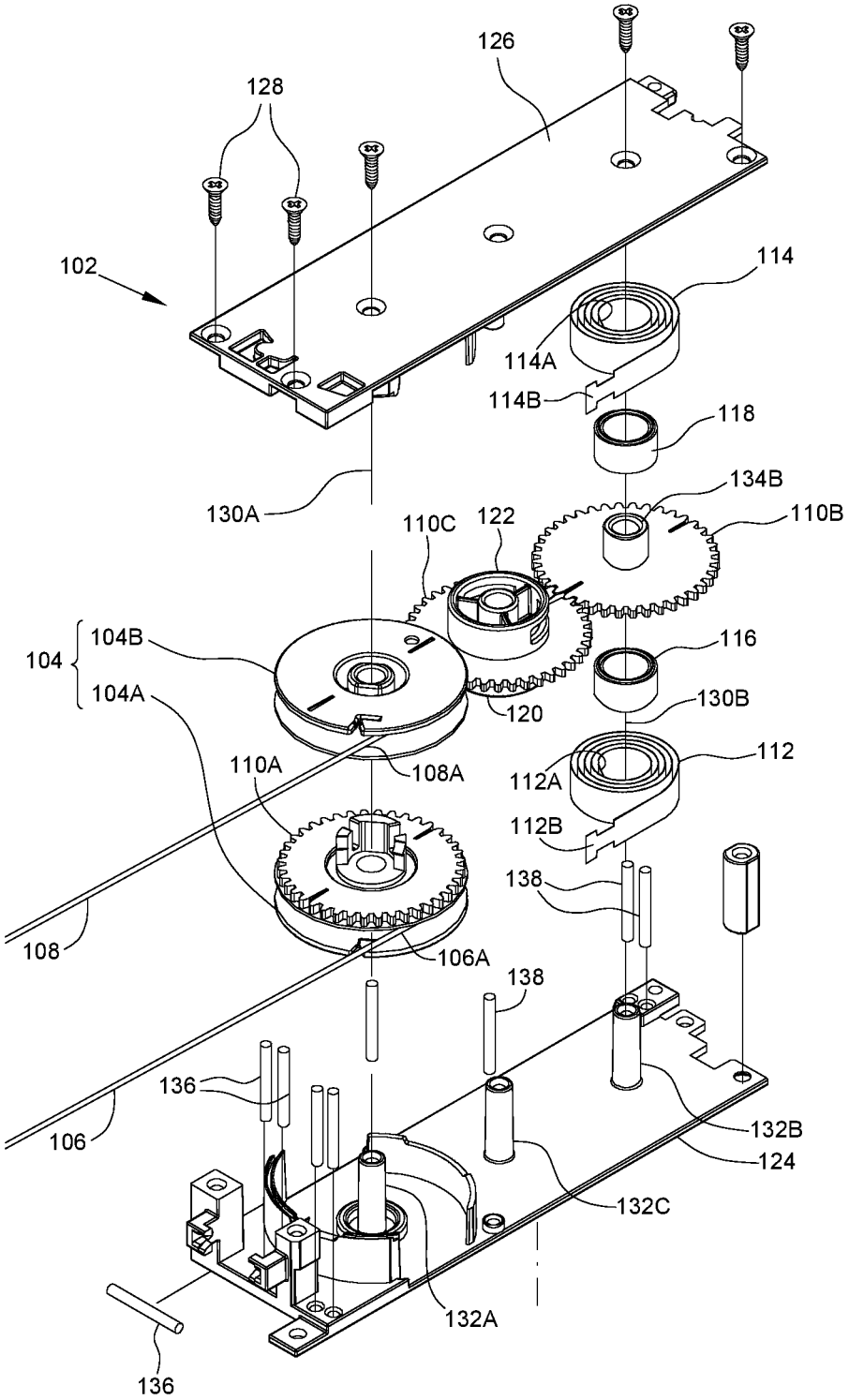
FIG. 1 is an exploded view illustrating an embodiment of a spring drive system for a window shade.
Figure 2:
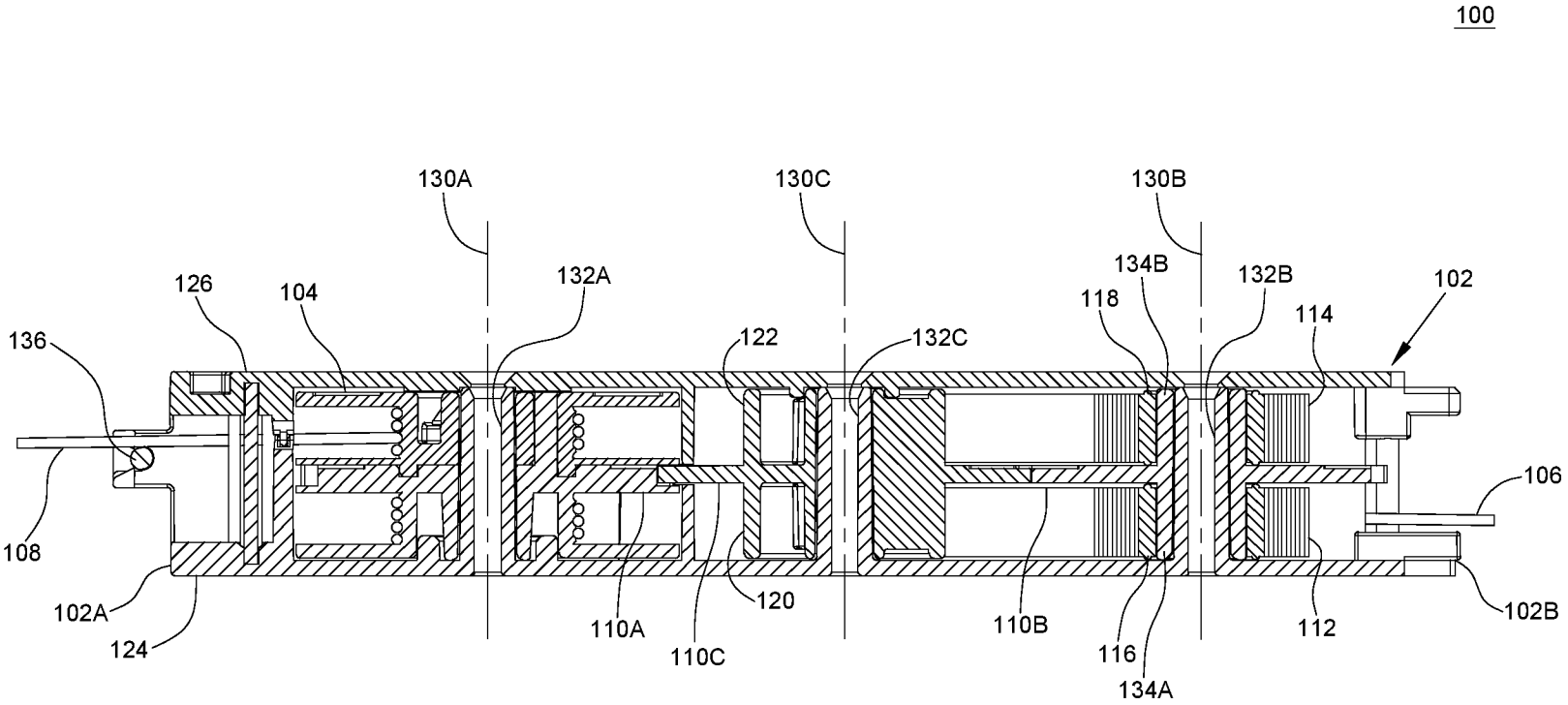
FIG. 2 is a cross-sectional view illustrating the spring drive system shown in FIG. 1.
Figure 3:
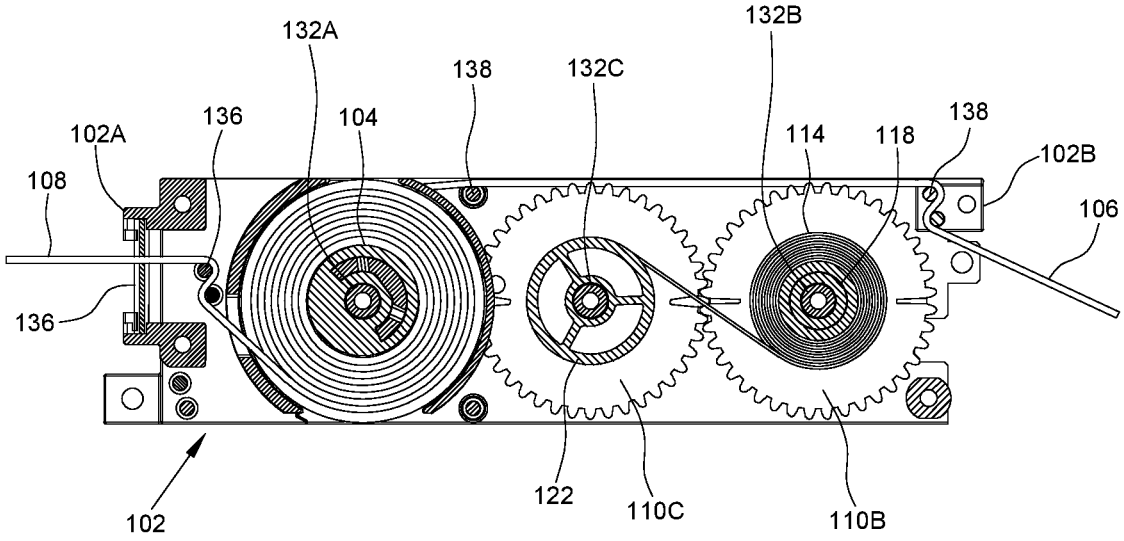
FIG. 3 is a planar view of the spring drive system shown in FIG. 1.

FIG. 1 is an exploded view illustrating an embodiment of a spring drive system 100 for a window shade, FIG. 2 is a cross-sectional view illustrating the spring drive system 100, and FIG. 3 is a planar view of the spring drive system 100. Referring to FIGS. 1-3, the spring drive system 100 includes a housing 102, a cord drum 104, two suspension cords 106 and 108, three gears 110A, 110B and 110C, two springs 112 and 114, two spring reels 116 and 118, and two take-up reels 120 and 122. According to an example of construction, the housing 102 can include two covers 124 and 126 that can be fixedly attached to each other via screws 128. The cord drum 104, the gears 110A, 110B and 110C, the springs 112 and 114, the spring reels 116 and 118, and the take-up reels 120 and 122 can be disposed in an interior of the housing 102 delimited at least partially between the two covers 124 and 126.

Referring to FIGS. 1 and 2, the cord drum 104 is fixedly connected with the gear 110A, and is respectively connected with the two suspension cords 106 and 108. According to an example of construction, the cord drum 104 can have two drum portions 104A and 104B fixedly connected with each other, and the two suspension cords 106 and 108 can have respective ends 106A and 108A respectively connected with the two drum portions 104A and 104B.

The gear 110A and the cord drum 104 comprised of the two drum portions 104A and 104B can be disposed in a coaxial manner. According to an example of construction, the gear 110A can be fixedly connected with the cord drum 104 with the two drum portions 104A and 104B respectively located at two opposite sides of the gear 110A. The cord drum 104 and the gear 110A attached thereto can be pivotally connected with the housing 102 about a pivot axis 130A. For example, the housing 102 can be fixedly connected with a shaft portion 132A, and the cord drum 104 and the gear 110A can be pivotally connected with the housing 102 at the shaft portion 132A. The cord drum 104 and the gear 110A can thereby rotate in unison about the pivot axis 130A relative to the housing 102 for winding and unwinding the two suspension cords 106 and 108.

Referring to FIGS. 1-3, the gear 110B can be pivotally connected with the housing 102 about a pivot axis 130B. For example, the housing 102 can be fixedly connected with a shaft portion 132B, and the gear 110B can be pivotally connected with the housing 102 at the shaft portion 132B. The gear 110B can thereby rotate in either direction about the pivot axis 130B relative to the housing 102.

The two spring reels 116 and 118 and the gear 110B can be disposed in a coaxial manner with the two spring reels 116 and 118 respectively connected pivotally at two opposite sides of the gear 110B. For example, the gear 110B can be fixedly connected with two coaxial shaft portions 134A and 134B protruding from two opposite sides of the gear 110B, and the two spring reels 116 and 118 can be pivotally connected about the two shaft portions 134A and 134B. The two spring reels 116 and 118 can thereby respectively rotate independently about the pivot axis 130B relative to the gear 110B and the housing 102.

Referring to FIGS. 1-3, the gear 110C is pivotally connected with the housing 102 about a pivot axis 130C, and is fixedly connected with the two take-up reels 120 and 122 at two opposite sides thereof. For example, the housing 102 can be fixedly connected with a shaft portion 132C, and the gear 110C can be pivotally connected with the housing 102 at the shaft portion 132C. The gear 110C and the two take-up reels 120 and 122 can be disposed in a coaxial manner, so that the gear 110C and the take-up reels 120 and 122 can rotate in unison relative to the housing 102 about the pivot axis 130C. Moreover, the gear 110C is respectively meshed with the gears 110A and 110B, so that the three gears 110A, 110B and 110C and the two take-up reels 120 and 122 are rotationally linked to one another in operation. According to an example of construction, the respective pivot axes 130A, 130B and 130C of the gears 110A, 110B and 110C can be disposed along a same straight line.

The springs 112 and 114 can be coiled ribbon springs, and can be assembled coaxially about the pivot axis 130B. More specifically, the spring 112 is assembled around the spring reel 116 with a first end 112A of the spring 112 disposed adjacent to the spring reel 116 (e.g., there may be a contact or no contact between the first end 112A of the spring 112 and the spring reel 116) and a second end 112B of the spring 112 anchored with the take-up reel 120. Likewise, the spring 114 is assembled around the spring reel 118 with a first end 114A of the spring 114 disposed adjacent to the spring reel 118 (e.g., there may be a contact or no contact between the first end 114A of the spring 114 and the spring reel 118) and a second end 114B of the spring 114 anchored with the take-up reel 122. The two springs 112 and 114 can respectively unwind from the two spring reels 116 and 118 and wind around the two take-up reels 120 and 122 when the cord drum 104 rotates for unwinding the two suspension cords 106 and 108. Moreover, the two springs 112 and 114 can respectively unwind from the two take-up reels 120 and 122 and wind around the two spring reels 116 and 118 to urge the cord drum 104 in rotation for winding the two suspension cords 106 and 108. The two spring reels 116 and 118 can facilitate unwinding and winding movements of the two springs 112 and 114, and would not necessarily move along with the springs 112 and 114.

Referring to FIGS. 1-3, the spring drive system 100 can further include a cord guide structure that can facilitate routing of the two suspension cords 106 and 108 inside the housing 102. For example, the cord guide structure can include a plurality of guide members 136 for the suspension cord 108, and a plurality of guide members 138 for the suspension cord 106. The guide members 136 and 138 can be connected with the housing 102, and exemplary include fixed shaft portions, pulleys, and the like. The suspension cord 106 can be routed in contact with the guide members 138, and the suspension cord 108 can be routed in contact with the guide members 136.

The two suspension cords 106 and 108 may be routed so as to exit the housing 102 at two opposite ends 102A and 102B thereof, or to exit the housing 102 at a same one of the two ends 102A and 102B. Referring to the example shown in FIGS. 2 and 3, the suspension cord 106 can extend from the cord drum 104 past the two gears 110B and 110C, the springs 112 and 114, the spring reels 116 and 118 and the take-up reels 120 and 122 to the end 102B of the housing 102, and exit the housing 102 at the end 102B thereof. In particular, the suspension cord 106 may exemplary extend adjacent and parallel to a side edge of the housing 102 extending between the two ends 102A and 102B thereof. The suspension cord 108 can extend in a direction opposite to that of the suspension cord 106 from the cord drum 104 to the end 102A of the housing 102, and exit the housing 102 at the end 102A thereof. According to an example of construction, the suspension cord 108 may extend at a level above that of the suspension cord 106 inside the housing 102.

Figure 4:
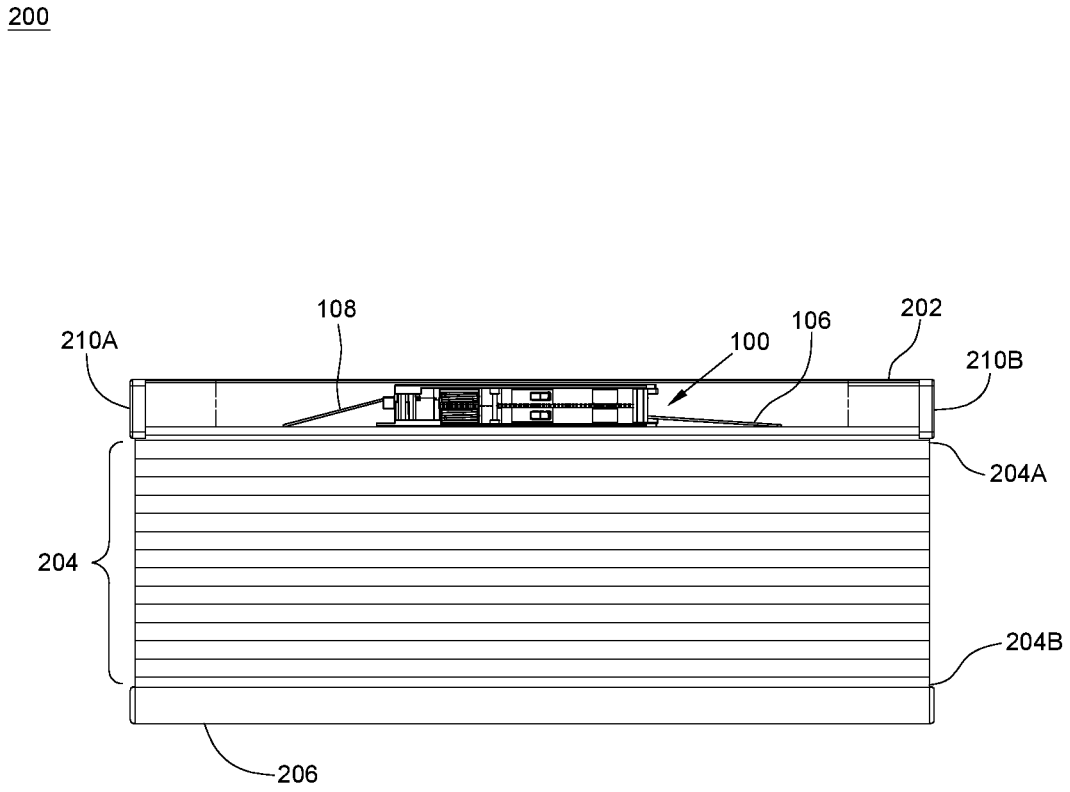
FIG. 4 is a front view illustrating an embodiment of a window shade incorporating the spring drive system shown in FIGS. 1-3.
Figure 5:
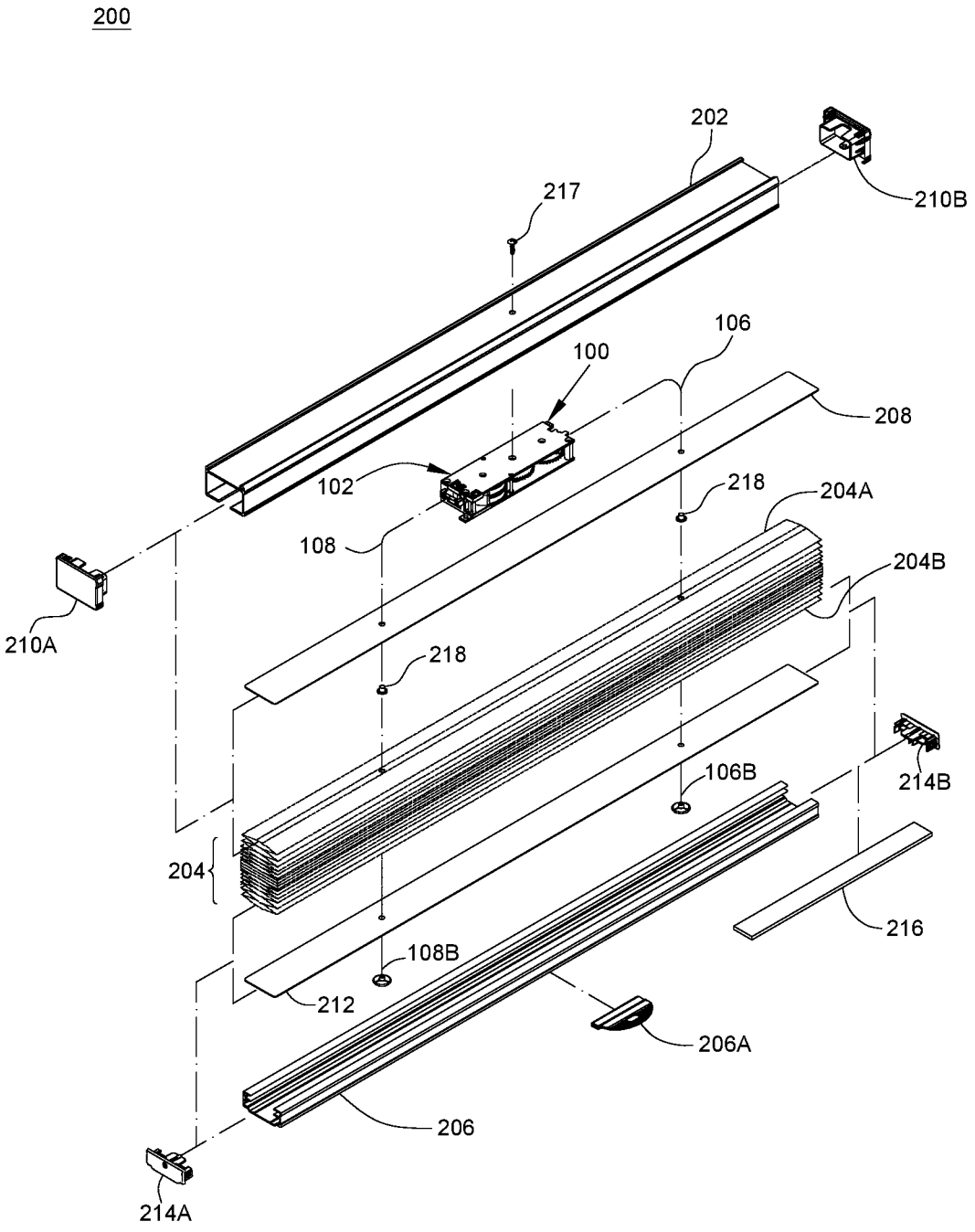
FIG. 5 is an exploded view illustrating the window shade shown in FIG. 4.

In conjunction with FIGS. 1-3, FIGS. 4 and 5 are respectively a front and an exploded view illustrating an embodiment of a window shade 200 incorporating the spring drive system 100. The window shade 200 can be a cordless window shade. "Cordless window shade" as used herein means a window shade having no operating cord exposed for a user's operation. Referring to FIGS. 4 and 5, the window shade 200 can include a head rail 202, a shading structure 204, and a bottom part 206 disposed at a bottom of the shading structure 204. The head rail 202 may be of any types and shapes. The head rail 202 may be affixed at a top of a window frame, and the shading structure 204 and the bottom part 206 can be suspended from the head rail 202.

The shading structure 204 can have any suitable constructions. For example, the shading structure 204 can include a honeycomb structure made from a cloth material (as shown), a Venetian blind construction, or a plurality of slats distributed vertically and parallel to one another. The shading structure 204 can have two opposite ends 204A and 204B respectively disposed adjacent to the head rail 202 and the bottom part 206. For example, the shading structure 204 can have a honeycomb structure, and the end 204A of the shading structure 204 may be provided with a strip 208 that is engaged with the head rail 202 so as to attach the end 204A of the shading structure 204 to the head rail 202. Two end caps 210A and 210B may respectively close two opposite ends of the head rail 202 so as to restrain the strip 208 inside the head rail 202. Likewise, the end 204B of the shading structure 204 can be provided with a strip 212 that is engaged with the bottom part 206 so as to attach the end 204B of the shading structure 204 to the bottom part 206. Two end caps 214A and 214B may respectively close two opposite ends of the bottom part 206 so as to restrain the strip 212 inside the bottom part 206.

The bottom part 206 is movable vertically relative to the head rail 202 to expand and collapse the shading structure 204. According to an example of construction, the bottom part 206 may be formed as an elongated rail. The bottom part 206 may be fixedly connected with a handle 206A for facilitating its operation. Moreover, a weighing element 216 may be attached to the bottom part 206 to add stability as desired.

Referring to FIGS. 1-5, the spring drive system 100 can be disposed in the head rail 202 or the bottom part 206 of the window shade 200, and can operate to sustain the shading structure 204 and the bottom part 206 at any desirable height. In the embodiment illustrated in FIGS. 1-5, the housing 102 of the spring drive system 100 can be exemplary affixed to the head rail 202 via one or more screw 217, and the two suspension cords 106 and 108 can have respective distal ends 106B and 108B affixed to the bottom part 206. It would be appreciated, however, that the housing 102 of the spring drive system 100 may be alternatively affixed to the bottom part 206, and the two suspension cords 106 and 108 may have respective distal ends 106B and 108B affixed to the head rail 202. The shading structure 204 may include grommets 218 through which the suspension cords 106 and 108 may be routed for passage through the shading structure 204.

Figure 6:
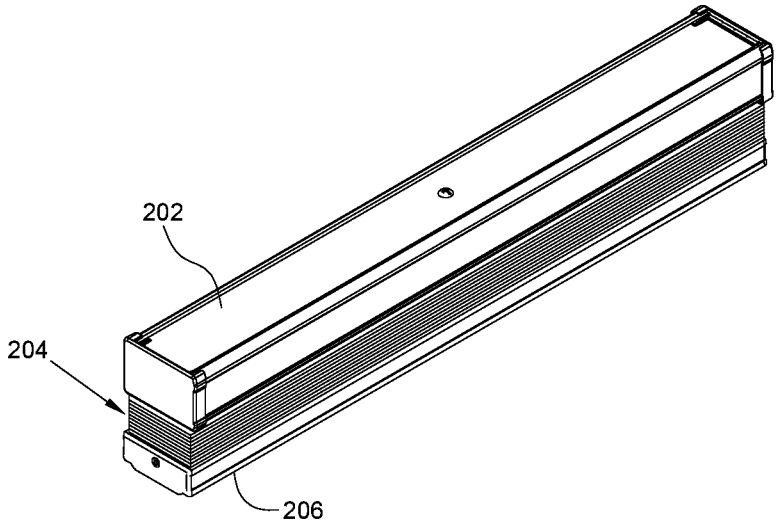
FIG. 6 is a perspective view illustrating the window shade of FIG. 4 with the bottom part held in a fully raised position.
Figure 7:
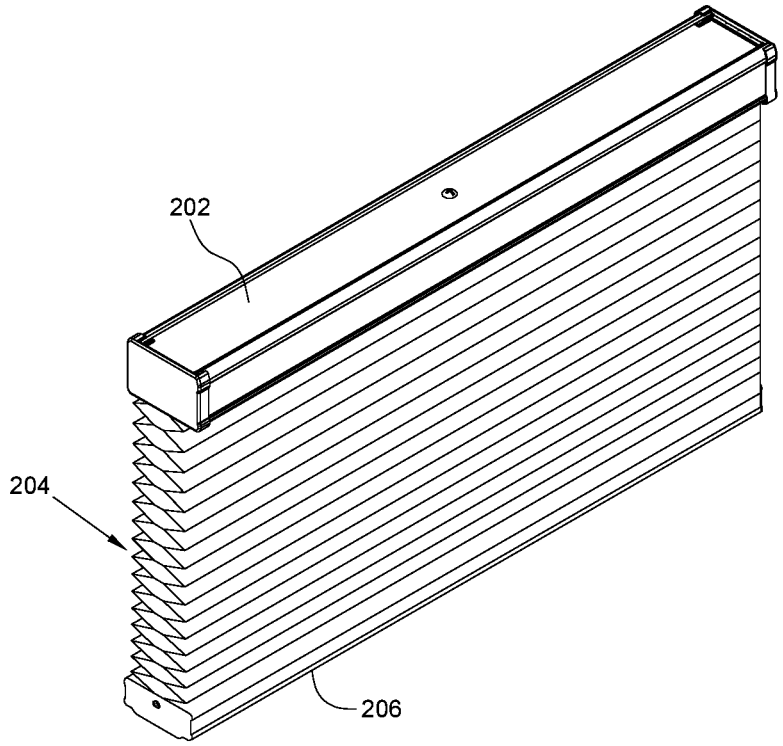
FIG. 7 is a perspective view illustrating the window shade of FIG. 4 with the bottom part held in a lowered position.

With the aforementioned assembly, the two springs 112 and 114 of the spring drive system 100 are operable to counteract a weight applied on the bottom part 206 for sustaining the bottom part 206 stationary at any desirable height relative to the head rail 202. For example, FIG. 6 exemplary illustrates the window shade 200 with the bottom part 206 held in a fully raised position, FIG. 7 illustrates the window shade 200 with the bottom part 206 held in a lowered position.

When the bottom part 206 is in the fully raised position, the two springs 112 and 114 of the spring drive system 100 can be substantially wound around the two spring reels 116 and 118, and apply a biasing force that keeps the bottom part 206 stationary. Moreover, the two suspension cords 106 and 108 can be substantially wound around the cord drum 104. This can correspond to the state of the spring drive system 100 illustrated in FIG. 3.

Figure 8:
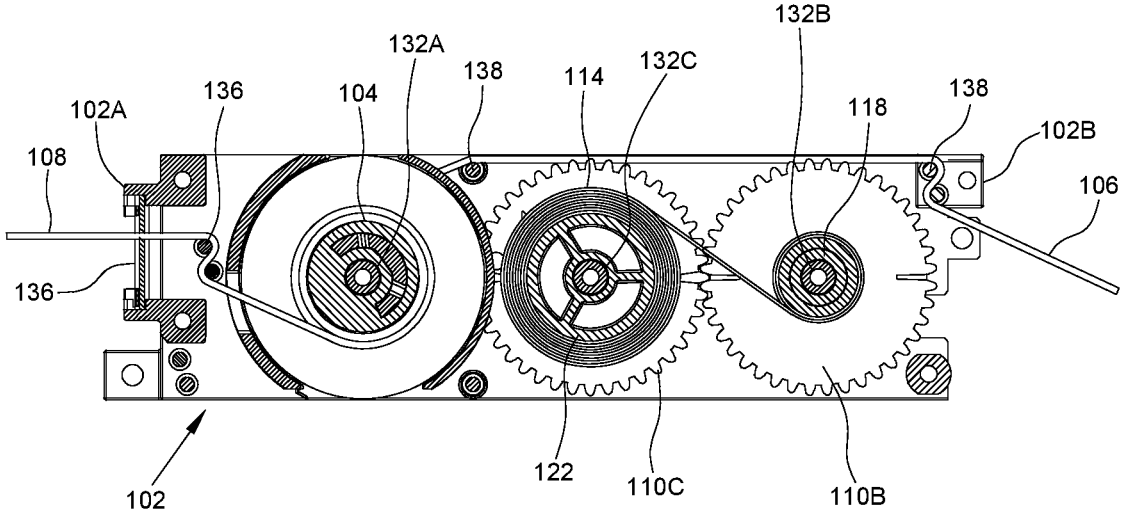
FIG. 8 is a planar view illustrating exemplary operation of the spring drive system in the window shade shown in FIG. 4.

As the bottom part 206 is lowered (e.g., pulled downward by a user), the two suspension cords 106 and 108 can unwind from the cord drum 104, which rotates along with the gears 110A, 110B and 110C and the take-up reels 120 and 122. As a result, the two springs 112 and 114 can respectively unwind from the two spring reels 116 and 118 and wind around the two take-up reels 120 and 122. This can correspond to the state of the spring drive system 100 illustrated in FIG. 8.

When the bottom part 206 moves toward the head rail 202 (e.g., pushed upward by a user), the two springs 112 and 114 can respectively unwind from the two take-up reels 120 and 122 and wind around the two spring reels 116 and 118, and can apply a biasing force that urges the cord drum 104 to rotate for winding the two suspension cords 106 and 108.

Figure 9:
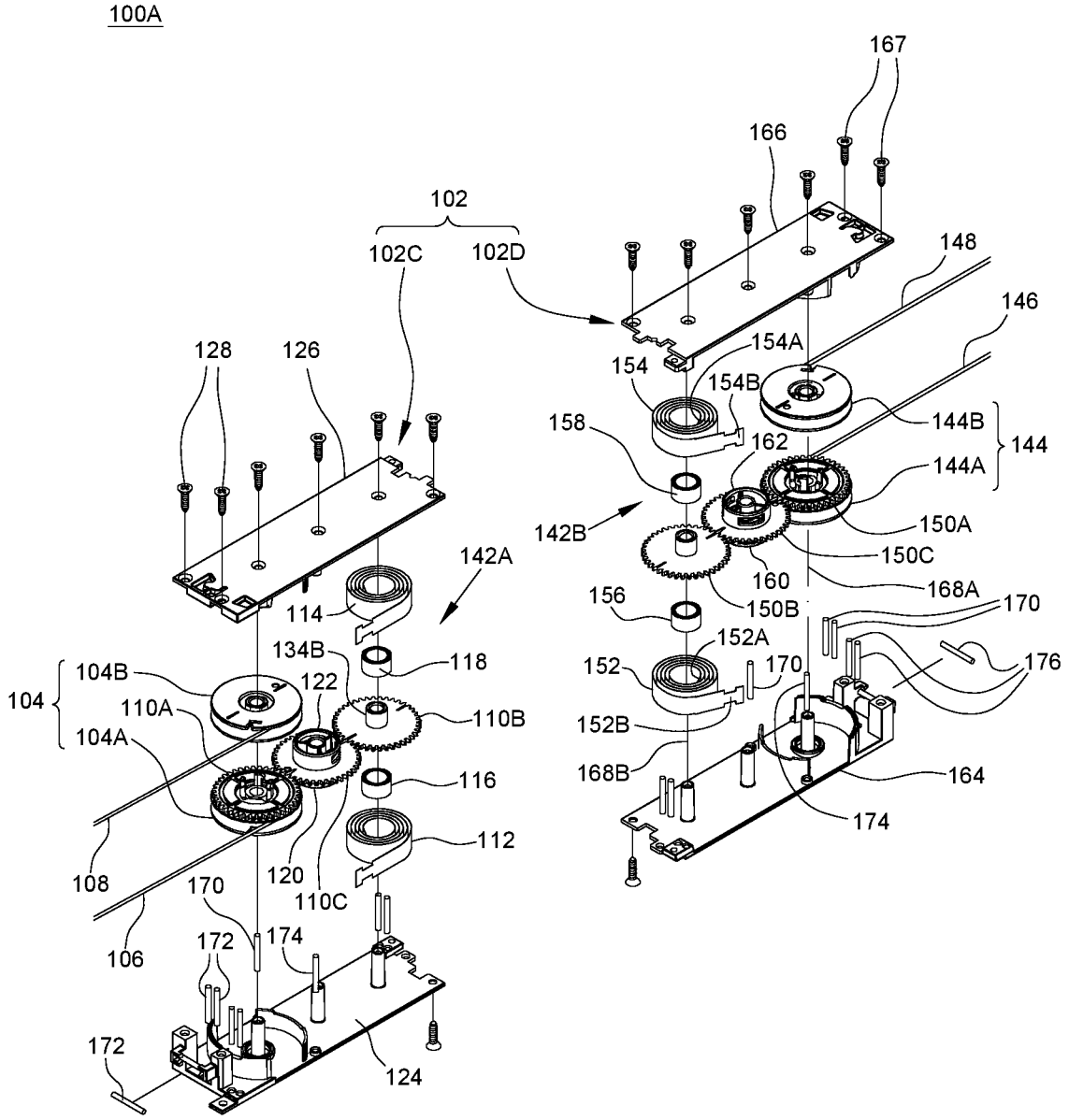
FIG. 9 is an exploded view illustrating another embodiment of a spring drive system.
Figure 10:
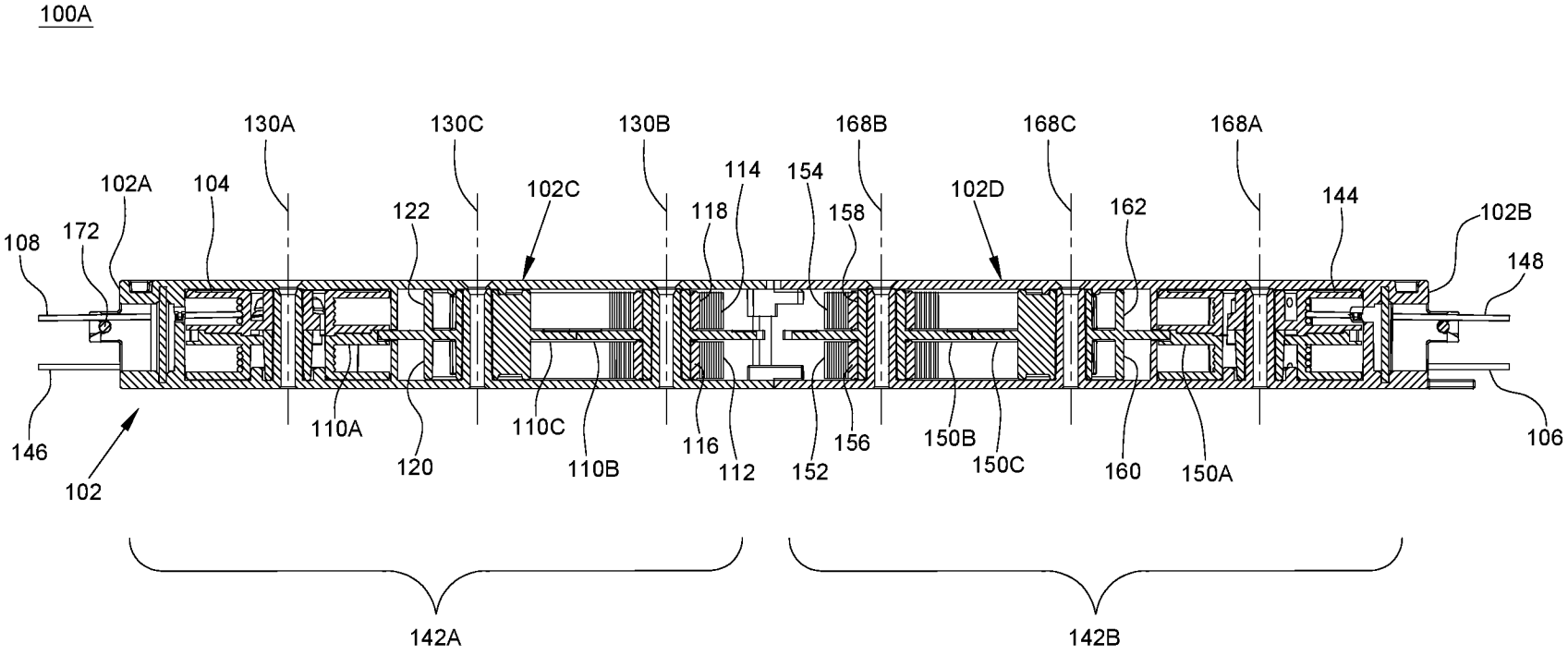
FIG. 10 is a cross-sectional view illustrating the spring drive system shown in FIG. 9.
Figure 11:
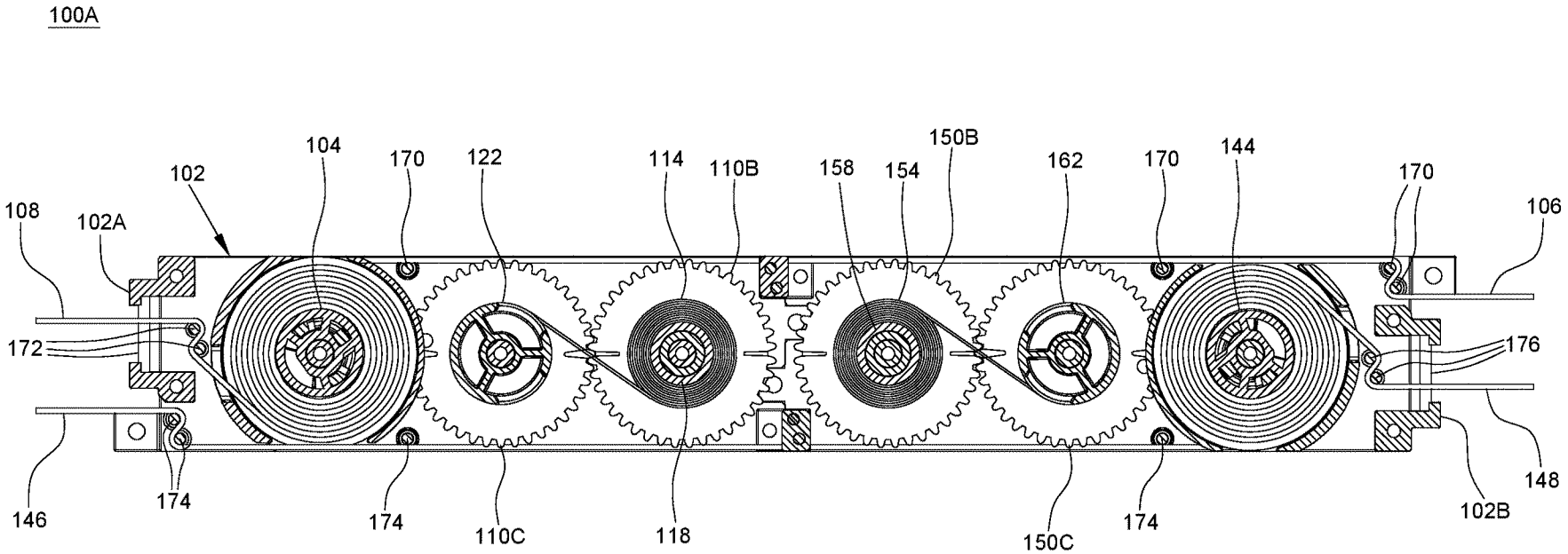
FIG. 11 is a planar view of the spring drive system shown in FIG. 9.
Figure 12:
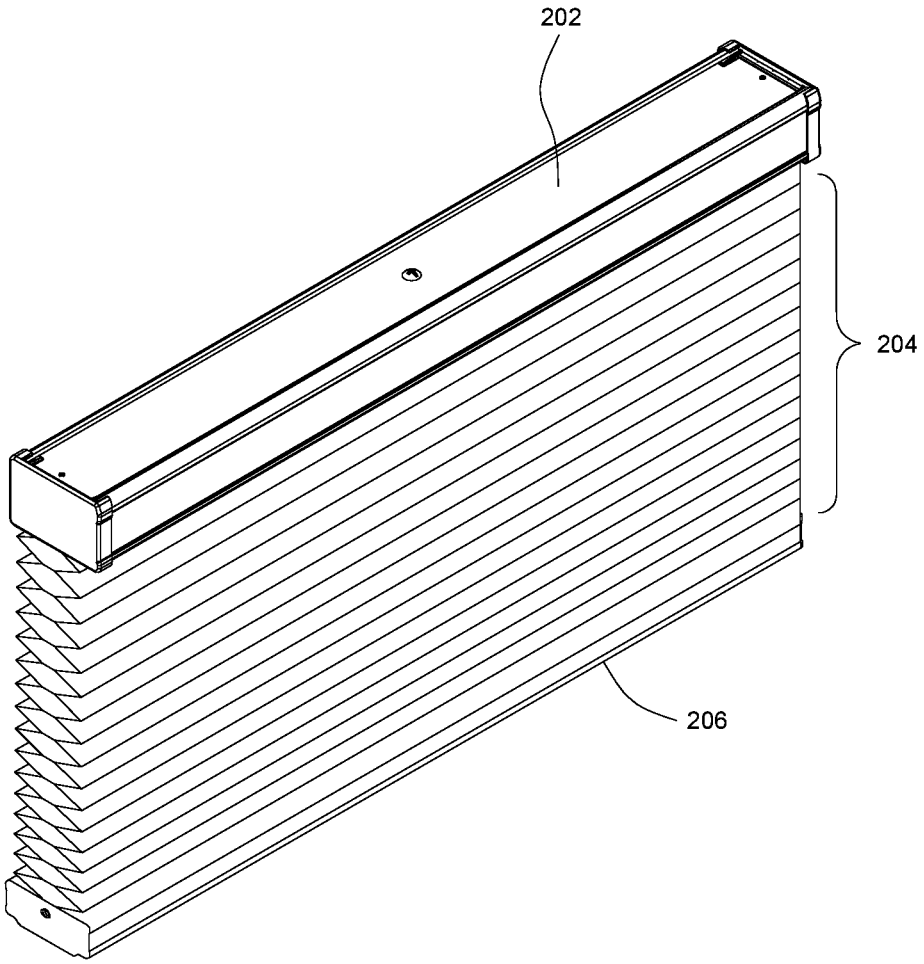
FIG. 12 is a perspective view illustrating an embodiment of a window shade incorporating the spring drive system shown in FIGS. 9-11.
Figure 13:
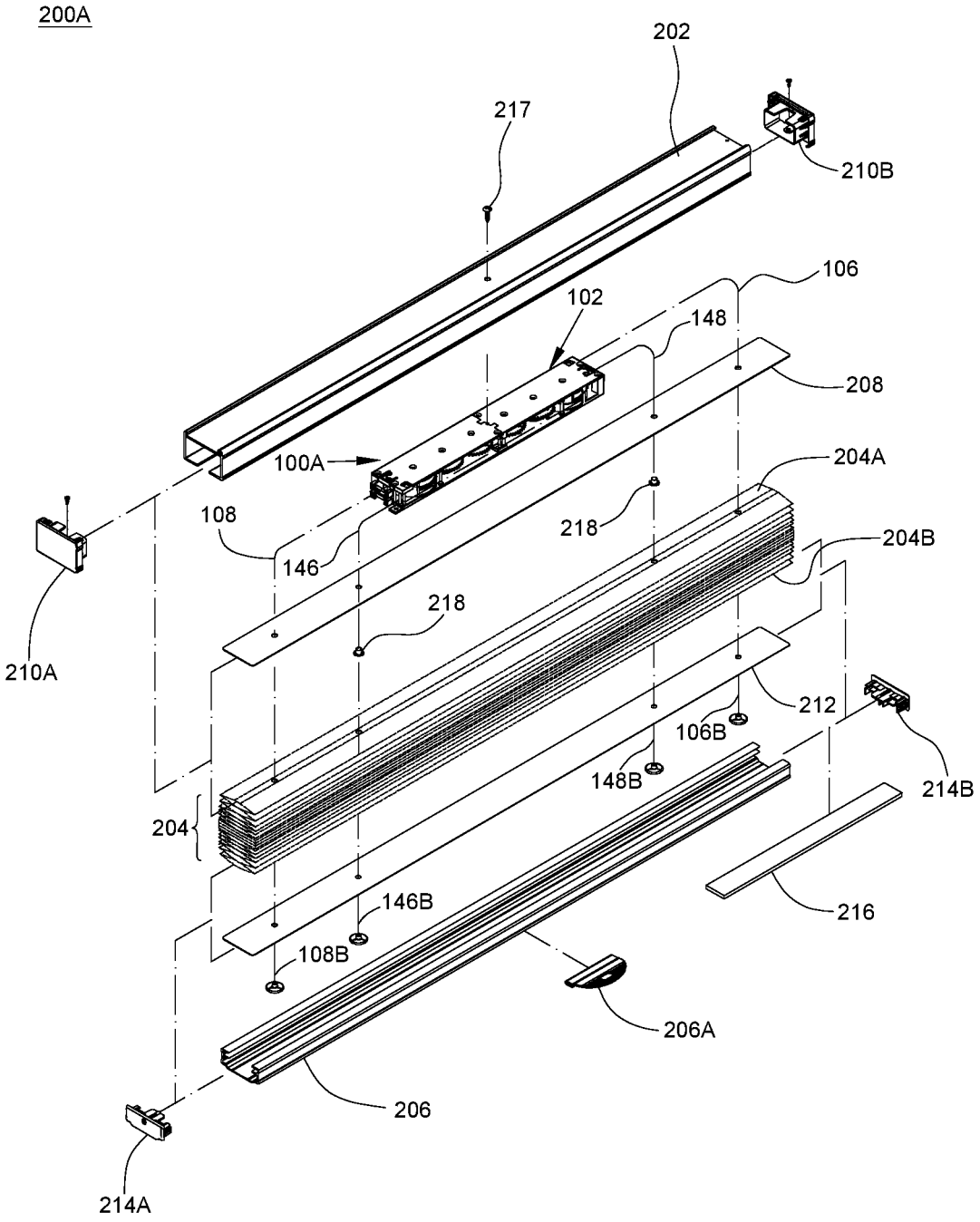
FIG. 13 is an exploded view of the window shade shown in FIG. 12.

According to the needs, the spring drive system 100 described herein may be expanded by incorporating multiple assemblies each similarly comprised of the cord drum 104, the two suspension cords 106 and 108, the three gears 110A, 110B and 110C, the two springs 112 and 114, the two spring reels 116 and 118 and the two take-up reels 120 and 122 as described previously. FIG. 9 is an exploded view illustrating another embodiment of a spring drive system 100A including multiple similar assemblies of the aforementioned set of components. FIG. 10 is a cross-sectional view illustrating the spring drive system 100A, and FIG. 11 is a planar view of the spring drive system 100A. Referring to FIGS. 9-11, the spring drive system 100A can include an assembly 142A comprised of the cord drum 104, the two suspension cords 106 and 108, the three gears 110A, 110B and 110C, the two springs 112 and 114, the two spring reels 116 and 118 and the two take-up reels 120 and 122, which have the same construction and are assembled like described previously. The assembly 142A can be carried by the two covers 124 and 126 that form a housing portion 102C of the housing 102.

Moreover, the spring drive system 100A can include another assembly 142B comprised of a cord drum 144, two suspension cords 146 and 148, three gears 150A, 150B and 150C, two springs 152 and 154, two spring reels 156 and 158 and two take-up reels 160 and 162. The assembly 142B can be carried by a housing portion 102D comprised of two covers 164 and 166 fixedly attached to each other via screws 167.

Referring to FIGS. 9-11, the two assemblies 142A and 142B are similar. Like previously described, the cord drum 144 and the gear 150A of the assembly 142B are fixedly connected with each other in a coaxial manner, and are pivotally connected with the housing portion 102D about a pivot axis 168A. The two suspension cords 146 and 148 are respectively connected with two drum portions 144A and 144B of the cord drum 144 at two opposite sides of the gear 150A. The gear 150B is pivotally connected with the housing portion 102D about a pivot axis 168B, and the two spring reels 156 and 158 and the gear 150B are disposed in a coaxial manner with the two spring reels 156 and 158 respectively connected pivotally at two opposite sides of the gear 150B. The two spring reels 156 and 158 can thereby respectively rotate independently about the pivot axis 168B relative to the gear 150B and the housing portion 102D. The gear 150C is pivotally connected with the housing portion 102D about a pivot axis 168C, is respectively meshed with the two gears 150A and 150B, and is fixedly connected with the two take-up reels 160 and 162 at two opposite sides thereof. The spring 152 is a coiled ribbon spring, and is assembled around the spring reel 156 with a first end 152A of the spring 152 disposed adjacent to the spring reel 156 (e.g., there may be a contact or no contact between the first end 152A of the spring 152 and the spring reel 156) and a second end 152B of the spring 152 anchored with the take-up reel 160. Likewise, the spring 154 is a coiled ribbon spring, and is assembled around the spring reel 158 with a first end 154A of the spring 154 disposed adjacent to the spring reel 158 (e.g., there may be a contact or no contact between the first end 154A of the spring 154 and the spring reel 158) and a second end 154B of the spring 154 anchored with the take-up reel 162. The two spring reels 156 and 158 can facilitate unwinding and winding movements of the two springs 152 and 154, and would not necessarily move along with the springs 152 and 154.

The two housing portions 102C and 102D can be fixedly attached to each other so that the two assemblies 142A and 142B are disposed adjacent to each other. The three gears 110A, 110B and 110C of the assembly 142A and the three gears 150A, 150B and 150C of the other assembly 142B can respectively form two gear trains that are operable independently from each other, and their respective pivot axes 130A, 130B, 130C, 168A, 168B and 168C can be disposed along a same straight line.

In the spring drive system 100A, the two springs 112 and 114 can respectively unwind from the two spring reels 116 and 118 and wind around the two take-up reels 120 and 122 when the cord drum 104 rotates for unwinding the two suspension cords 106 and 108, and respectively unwind from the two take-up reels 120 and 122 and wind around the two spring reels 116 and 118 to urge the cord drum 104 in rotation for winding the two suspension cords 106 and 108. Likewise, the two springs 152 and 154 can respectively unwind from the two spring reels 156 and 158 and wind around the two take-up reels 160 and 162 when the cord drum 144 rotates for unwinding the two suspension cords 146 and 148, and respectively unwind from the two take-up reels 160 and 162 and wind around the two spring reels 156 and 158 to urge the cord drum 144 in rotation for winding the two suspension cords 146 and 148.

Referring to FIGS. 9-11, the suspension cord 106 can extend from the cord drum 104 past the gears 110B and 110C of the assembly 142A and the gears 150A, 150B and 150C and the cord drum 144 of the assembly 142B to the end 102B of the housing 102, and exit the housing 102 at the end 102B. The suspension cord 108 can extend in a direction opposite to that of the suspension cord 106 from the cord drum 104 to the end 102A of the housing 102, and exit the housing 102 at the end 102A. The suspension cord 146 can extend from the cord drum 144 past the gears 150B and 150C of the assembly 142B and the gears 110A, 110B and 110C and the cord drum 104 of the assembly 142A to the end 102A of the housing 102, and exit the housing 102 at the end 102A. The suspension cord 148 can extend in a direction opposite to that of the suspension cord 146 from the cord drum 144 to the end 102B of the housing 102, and exit the housing 102 at the end 102B. According to an example of construction, the two suspension cords 108 and 148 can extend at one level inside the housing 102, and the two suspension cords 106 and 146 can extend at another level inside the housing 102 that is below the level of the two suspension cords 108 and 148. A plurality of guide members 170, 172, 174 and 176 can be provided in the housing 102 to respectively facilitate routing of the suspension cords 106, 108, 146 and 148 inside the housing 102. For example, the suspension cords 106 and 146 can be respectively routed adjacent and parallel to two opposite side edges of the housing 102 that extend between the two ends 102A and 102B.

In conjunction with FIGS. 9-11, FIGS. 12 and 13 are respectively a perspective and an exploded view illustrating an embodiment of a window shade 200A incorporating the spring drive system 100A. Referring to FIGS. 9-13, the window shade 200A can have a construction generally similar to that of the window shade 200 previously described, including the head rail 202, the shading structure 204 and the bottom part 206. The housing 102 of the spring drive system 100A can be exemplary affixed to the head rail 202, and the suspension cords 106, 108, 146 and 148 can have respective distal ends 106B, 108B, 146B and 148B affixed to the bottom part 206. It would be appreciated, however, that the housing 102 of the spring drive system 100A may be alternatively affixed to the bottom part 206, and the two suspension cords 106, 108, 146 and 148 may have respective distal ends affixed to the head rail 202.

In the window shade 200A, the two assemblies 142A and 142B of the spring drive system 100A can operate in a same manner like previously described when the bottom part 206 moves upward and downward relative to the head rail 202. For example, when the bottom part 206 is lowered, the two suspension cords 106 and 108 can unwind from the cord drum 104 and the two springs 112 and 114 can respectively unwind from the two spring reels 116 and 118 and wind around the two take-up reels 120 and 122, and the two suspension cords 146 and 148 can unwind from the cord drum 144 and the two springs 152 and 154 can respectively unwind from the two spring reels 156 and 158 and wind around the two take-up reels 160 and 162.

When the bottom part 206 moves toward the head rail 202, the two springs 112 and 114 can respectively unwind from the two take-up reels 120 and 122 and wind around the two spring reels 116 and 118 and can apply a biasing force that urges the cord drum 104 to rotate for winding the two suspension cords 106 and 108. Likewise, the two springs 152 and 154 can respectively unwind from the two take-up reels 160 and 162 and wind around the two spring reels 156 and 158 and can apply a biasing force that urges the cord drum 144 to rotate for winding the two suspension cords 146 and 148.

While the bottom part 206 is in any desired position, the springs 112, 114, 152 and 154 of the spring drive system 100A are operable to counteract a weight applied on the bottom part 206 for keeping the bottom part 206 stationary. Since the spring drive system 100A can provide a combined biasing force from four springs 112, 114, 152 and 154, the spring drive system 100A may be suitable for use with window shades having larger sizes.

In conjunction with FIGS. 9-11, FIGS. 14 and 15 are respectively a perspective and an exploded view illustrating another embodiment of a window shade 200B incorporating the spring drive system 100A. Referring to FIGS. 9-11, 14 and 15, the window shade 200B can include the head rail 202, the bottom part 206, an intermediate rail 220 and two shading structures 224 and 226. The intermediate rail 220 is disposed between the head rail 202 and the bottom part 206, and is configured to move relative to the head rail 202 independently from the bottom part 206. The intermediate rail 220 may be fixedly connected with a handle 220A for facilitating its operation.

Figure 14:
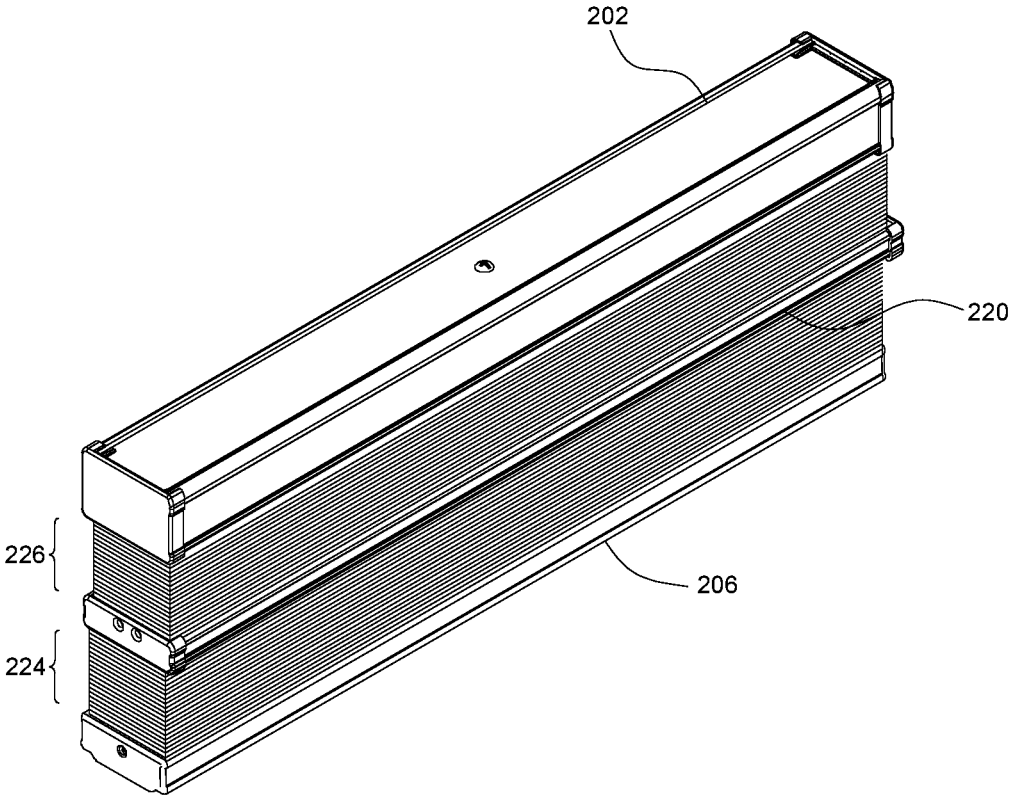
FIG. 14 is a perspective view illustrating another embodiment of a window shade incorporating the spring drive system shown in FIGS. 9-11.
Figure 15:
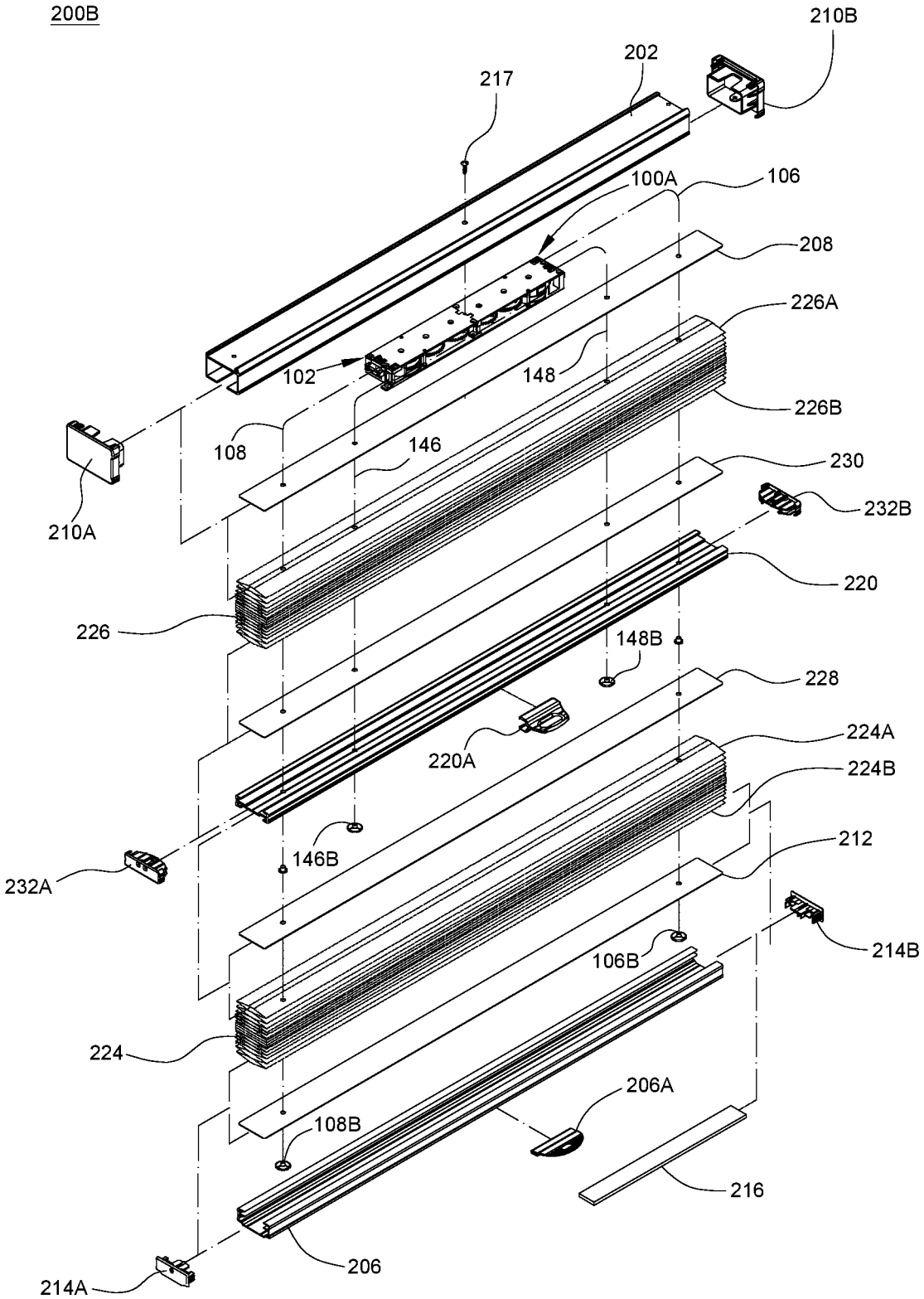
FIG. 15 is an exploded view of the window shade shown in FIG. 14.

Referring to FIGS. 14 and 15, the two shading structures 224 and 226 may exemplary have honeycomb structures. The shading structure 224 is disposed between the intermediate rail 220 and the bottom part 206, and has two opposite ends 224A and 224B respectively disposed adjacent to the intermediate rail 220 and the bottom part 206. For example, the end 224A of the shading structure 224 may be provided with a strip 228 that is engaged with the intermediate rail 220 so as to attach the end 224A of the shading structure 224 to the intermediate rail 220, and the other end 224B of the shading structure 224 may be likewise attached to the bottom part 206 via the strip 212.

The shading structure 226 is disposed between the head rail 202 and the intermediate rail 220, and has two opposite ends 226A and 226B respectively disposed adjacent to the head rail 202 and the intermediate rail 220. For example, the end 226A of the shading structure 226 may be provided with the strip 208 that is engaged with the head rail 202 so as to attach the end 226A of the shading structure 226 to the head rail 202, and the other end 226B of the shading structure 226 may be likewise attached to intermediate rail 220 via a strip 230. Two end caps 232A and 232B may respectively close two opposite ends of the intermediate rail 220 so as to restrain the strips 228 and 230 inside the intermediate rail 220.

Referring to FIGS. 14 and 15, the housing 102 of the spring drive system 100A can be affixed to the head rail 202 of the window shade 200B, the suspension cords 106 and 108 can be coupled to the bottom part 206, and the suspension cords 146 and 148 can be coupled to the intermediate rail 220. More specifically, the two suspension cords 106 and 108 can have respective distal ends 106B and 108B respectively affixed to the bottom part 206, and the two suspension cords 146 and 148 can have respective distal ends 146B and 148B respectively affixed to the intermediate rail 220.

Referring to FIGS. 9-11, 14 and 15, the two springs 112 and 114 of the spring drive system 100A are operable to counteract a weight applied on the bottom part 206 of the window shade 200B for sustaining the bottom part 206 stationary at any desirable position relative to the head rail 202. The two springs 152 and 154 are operable to counteract a weight applied on the intermediate rail 220 for sustaining the intermediate rail 220 stationary at any desirable position relative to the head rail 202. Moreover, the two springs 112 and 114 and the output drum 104 of the assembly 142A are operable independently from the two springs 152 and 154 and the output drum 144 of the assembly 142B.

Figure 16:
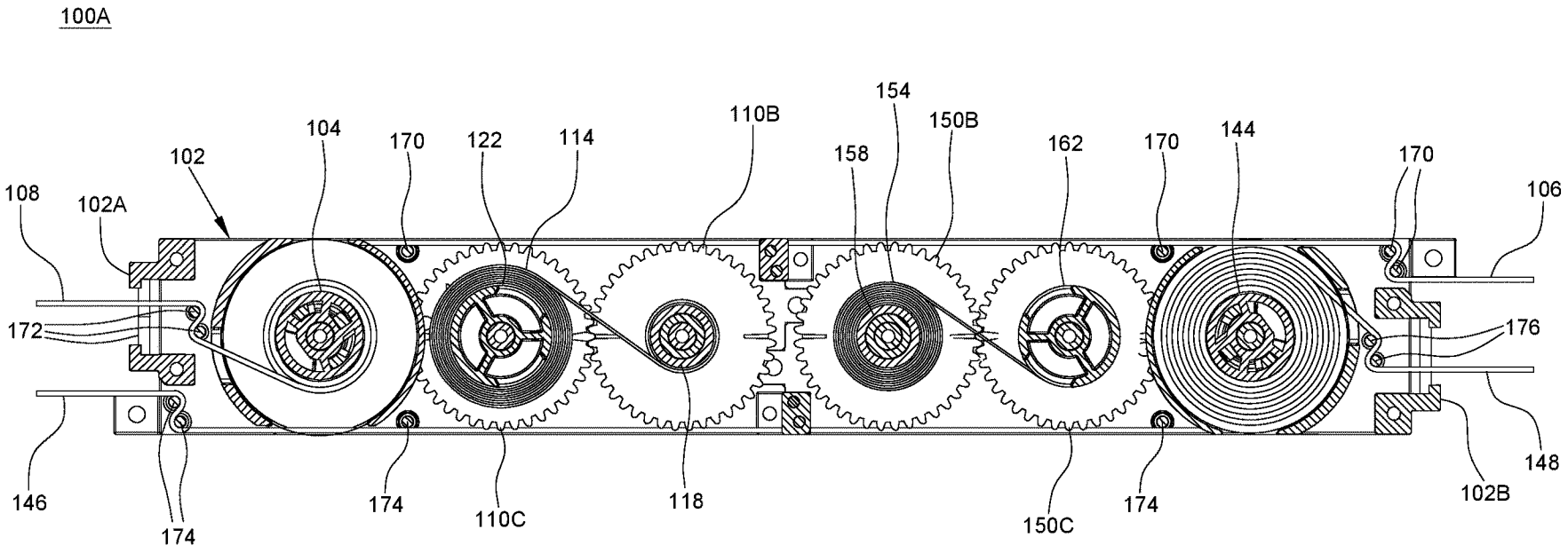
FIG. 16 is a planar view illustrating exemplary operation of the spring drive system in the window shade shown in FIG. 14.

When the bottom part 206 of the window shade 200B moves relative to the head rail 202 and the intermediate rail 220 while the intermediate rail 220 remains stationary, only the components of the assembly 142A move while those of the assembly 142B remain stationary. For example, when the bottom part 206 lowers relative to the head rail 202 and the intermediate rail 220 for expanding the shading structure 224, the two suspension cords 106 and 108 can unwind from the cord drum 104, which rotates along with the gears 110A, 110B and 110C and the take-up reels 120 and 122. As a result, the two springs 112 and 114 can respectively unwind from the two spring reels 116 and 118 and wind around the two take-up reels 120 and 122. When the bottom part 206 moves toward the intermediate rail 220 for collapsing the shading structure 224, the two springs 112 and 114 can respectively unwind from the two take-up reels 120 and 122 and wind around the two spring reels 116 and 118, and can apply a biasing force that urges the cord drum 104 to rotate for winding the two suspension cords 106 and 108. Meanwhile, the output drum 144, the gears 150A, 150B and 150C and the two springs 152 and 154 can remain stationary, because the intermediate rail 220 does not move and remains in position relative to the head rail 202. FIG. 16 exemplary illustrates the spring drive system 100A corresponding to a state where the bottom part 206 of the window shade 200B is in a lowered position and the intermediate rail 220 is in an initial position closer to the head rail 202.

Figure 17:
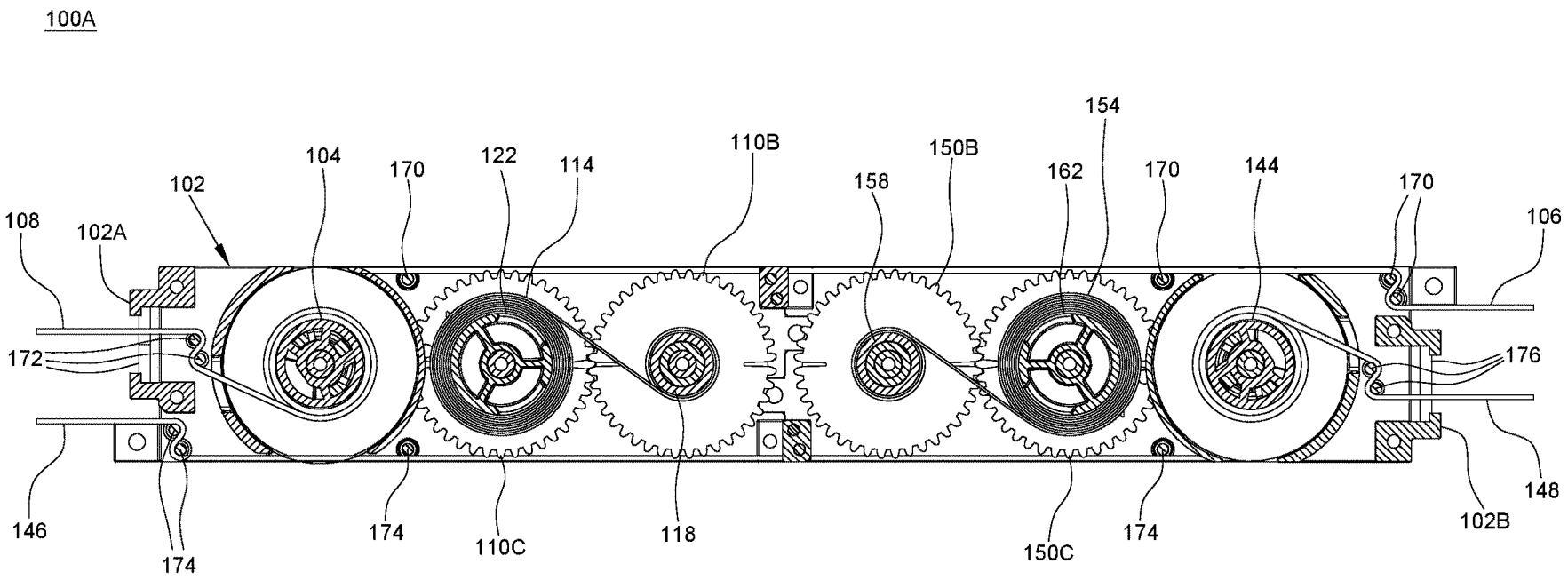
FIG. 17 is a planar view illustrating further operation of the spring drive system in the window shade shown in FIG. 14.

When the intermediate rail 220 moves relative to the head rail 202 and the bottom part 206 while the bottom part 206 remains stationary, only the components of the assembly 142B move while those of the assembly 142A remain stationary. For example, when the intermediate rail 220 moves away from the head rail 202 to a lowered position for expanding the shading structure 226, the two suspension cords 146 and 148 can unwind from the cord drum 144, which rotates along with the gears 150A, 150B and 150C and the take-up reels 160 and 162. As a result, the two springs 152 and 154 can respectively unwind from the two spring reels 156 and 158 and wind around the two take-up reels 160 and 162. When the intermediate rail 220 moves toward the head rail 202 for collapsing the shading structure 226, the two springs 152 and 154 can respectively unwind from the two take-up reels 160 and 162 and wind around the two spring reels 156 and 158, and can apply a biasing force that urges the cord drum 144 to rotate for winding the two suspension cords 146 and 148. Meanwhile, the output drum 104, the gears 110A, 110B and 110C and the two springs 112 and 114 can remain stationary, because the bottom part 206 does not move and remains in position relative to the head rail 202. FIG. 17 exemplary illustrates the spring drive system 100A corresponding to a state where the intermediate rail 220 of the window shade 200B is moved from its initial position to a lowered position.

Figure 18:
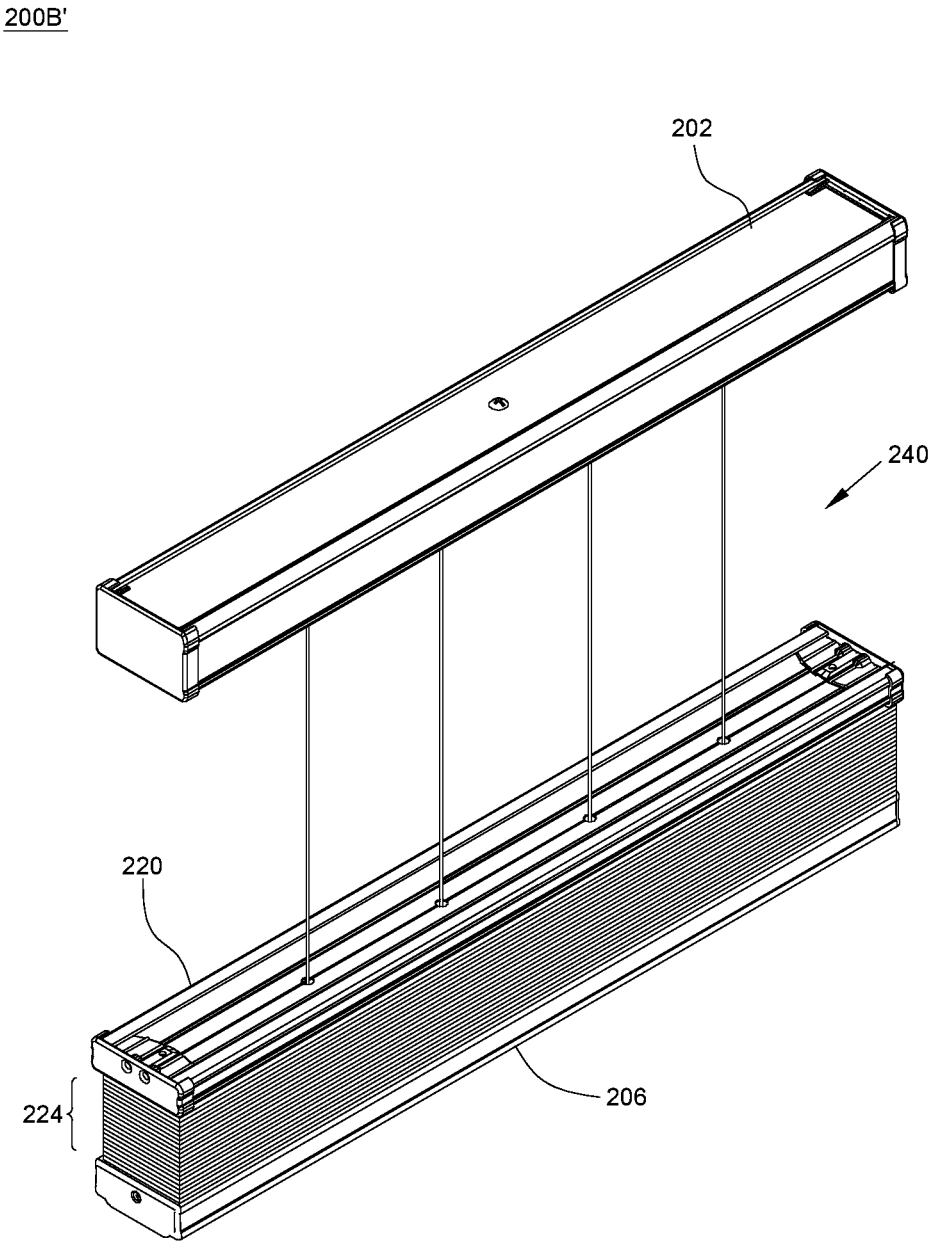
FIG. 18 is a perspective view illustrating a variant embodiment of the window shade shown in FIG. 14.

Although the window shade 200B has been described as including two shading structures 224 and 226, it will be appreciated that other embodiments may have only one of the two shading structures 224 and 226. For example, FIG. 18 is a perspective view illustrating a variant embodiment of a window shade 200B' that is similar to the window shade 200B described previously except that the shading structure 226 between the head rail 202 and the intermediate rail 220 is omitted. Referring to FIG. 18, the intermediate rail 220 of the window shade 200B' can move downward relative to the head rail 202 to create a gap 240 between the head rail 202 and the intermediate rail 220 for light passage, and can move upward to a position adjacent to the head rail 202 to close the gap 240 between the head rail 202 and the intermediate rail 220. The window shade 200B' shown in FIG. 18 can incorporate the same spring drive system 100A described previously, which can operate in a similar manner.

Figure 19:
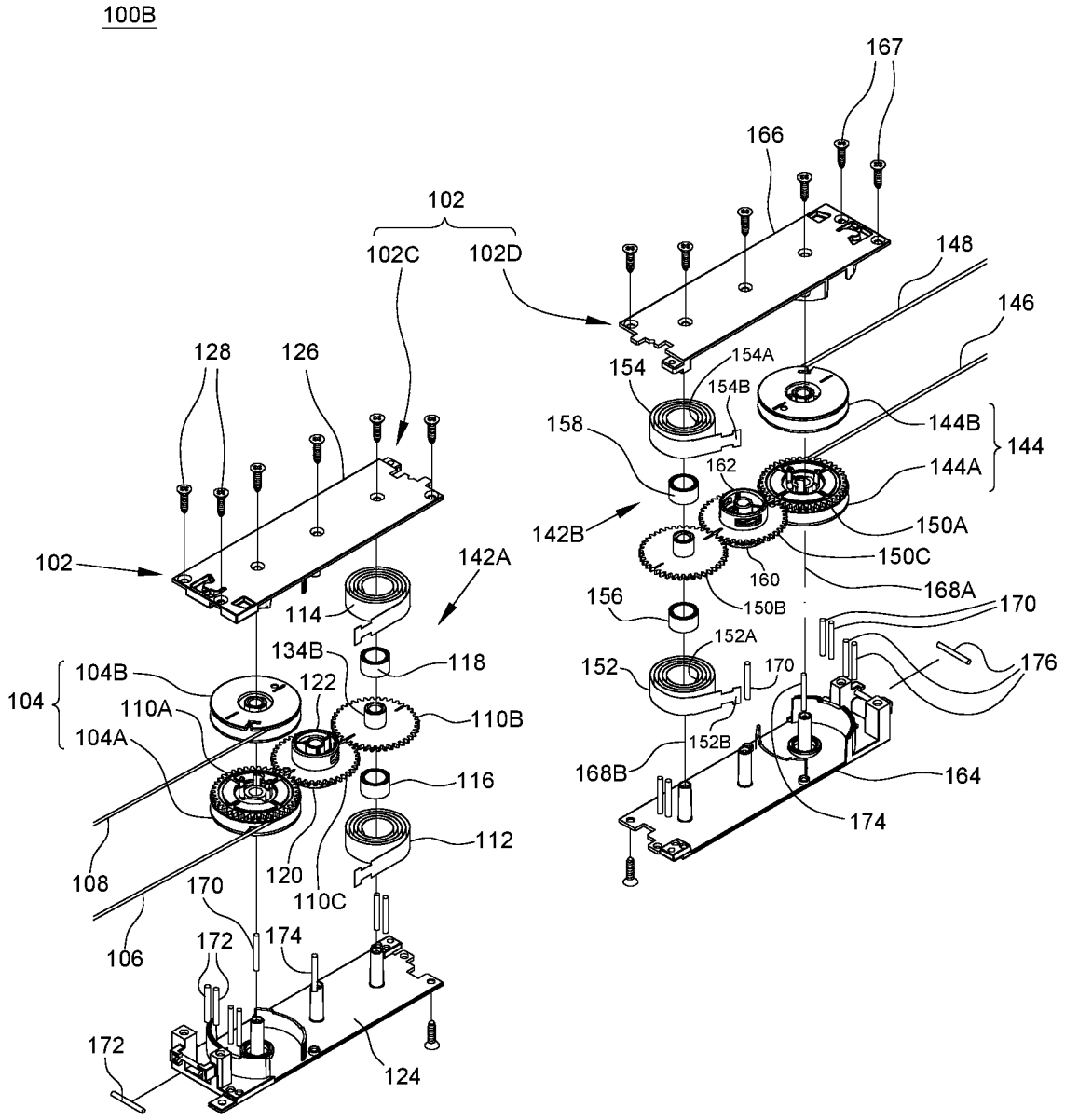
FIG. 19 is an exploded view illustrating another embodiment of a spring drive system.
Figure 20:
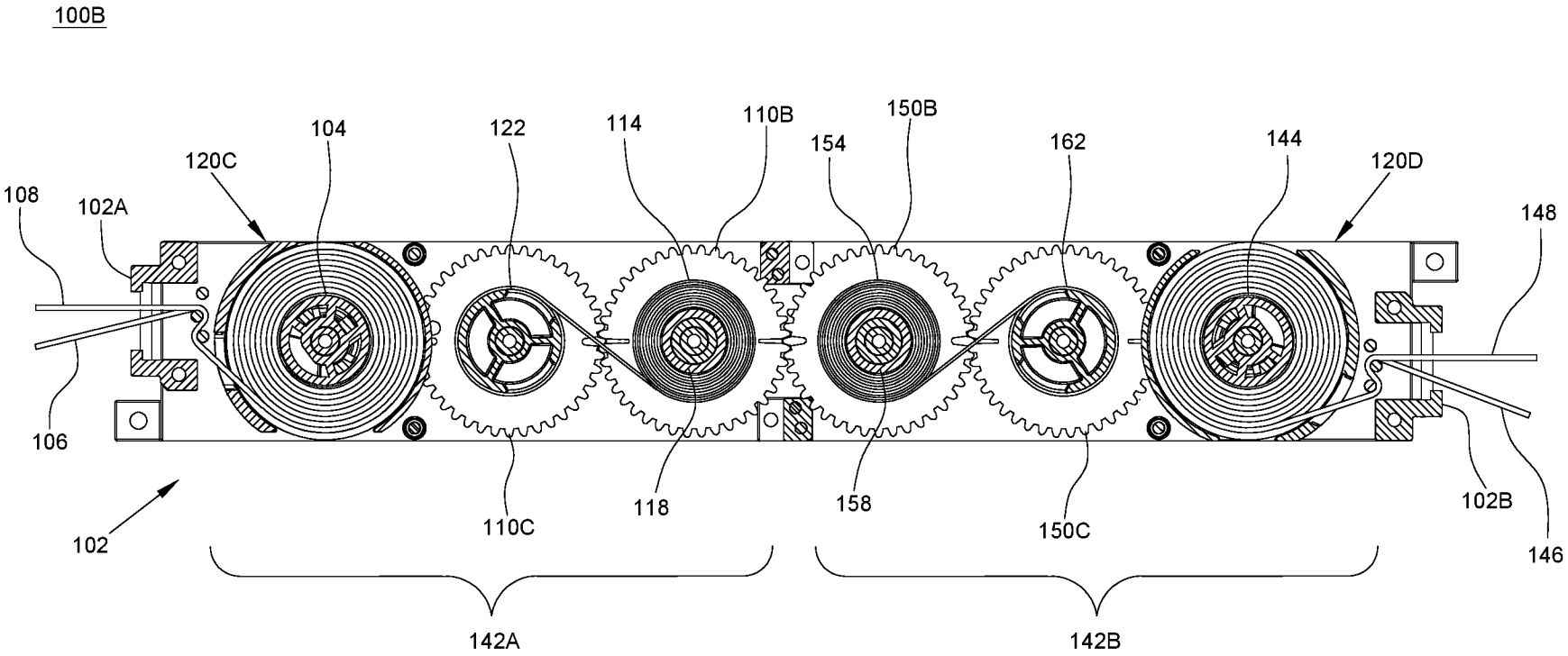
FIG. 20 is a planar view illustrating the spring drive system shown in FIG. 19.

FIGS. 19 and 20 are respectively an exploded and a planar view illustrating another embodiment of a spring drive system 100B suitable for use with a window shade. Referring to FIGS. 19 and 20, the spring drive system 100B is substantially similar to the spring drive system 100A described previously, including the two assemblies 142A and 142B carried by the housing 102. The assembly 142A is comprised of the cord drum 104, the two suspension cords 106 and 108, the three gears 110A, 110B and 110C, the two springs 112 and 114, the two spring reels 116 and 118 and the two take-up reels 120 and 122. The assembly 142B is comprised of the cord drum 144, the two suspension cords 146 and 148, the three gears 150A, 150B and 150C, the two springs 152 and 154, the two spring reels 156 and 158 and the two take-up reels 160 and 162.

In the spring drive system 100B, the two suspension cords 106 and 108 coupled to the cord drum 104 exit the housing 102 at the end 102A thereof, the two suspension cords 146 and 148 coupled to the cord drum 144 exit the housing 102 at the end 102B thereof, and the two gears 110B and 150B are further meshed with each other. In this manner, the two assemblies 142A and 142B of the spring drive system 100B are operatively linked to each other. For example, the cord drums 104 and 144 can concurrently rotate to unwind the suspension cords 106, 108, 146 and 148 at the same time, which causes the two springs 112 and 114 to respectively unwind from the two spring reels 116 and 118 and wind around the two take-up reels 120 and 122, and the two springs 152 and 154 to respectively unwind from the two spring reels 156 and 158 and wind around the two take-up reels 160 and 162. Moreover, the springs 112, 114, 152 and 154 can respectively unwind from the take-up reels 120, 122, 160 and 162 and wind around the spring reels 116, 118, 156 and 158 to drive the cord drums 104 and 144 in rotation for winding the suspension cords 106 and 108 around the cord drum 104 and the suspension cords 146 and 148 around the cord drum 144.

Figure 21:
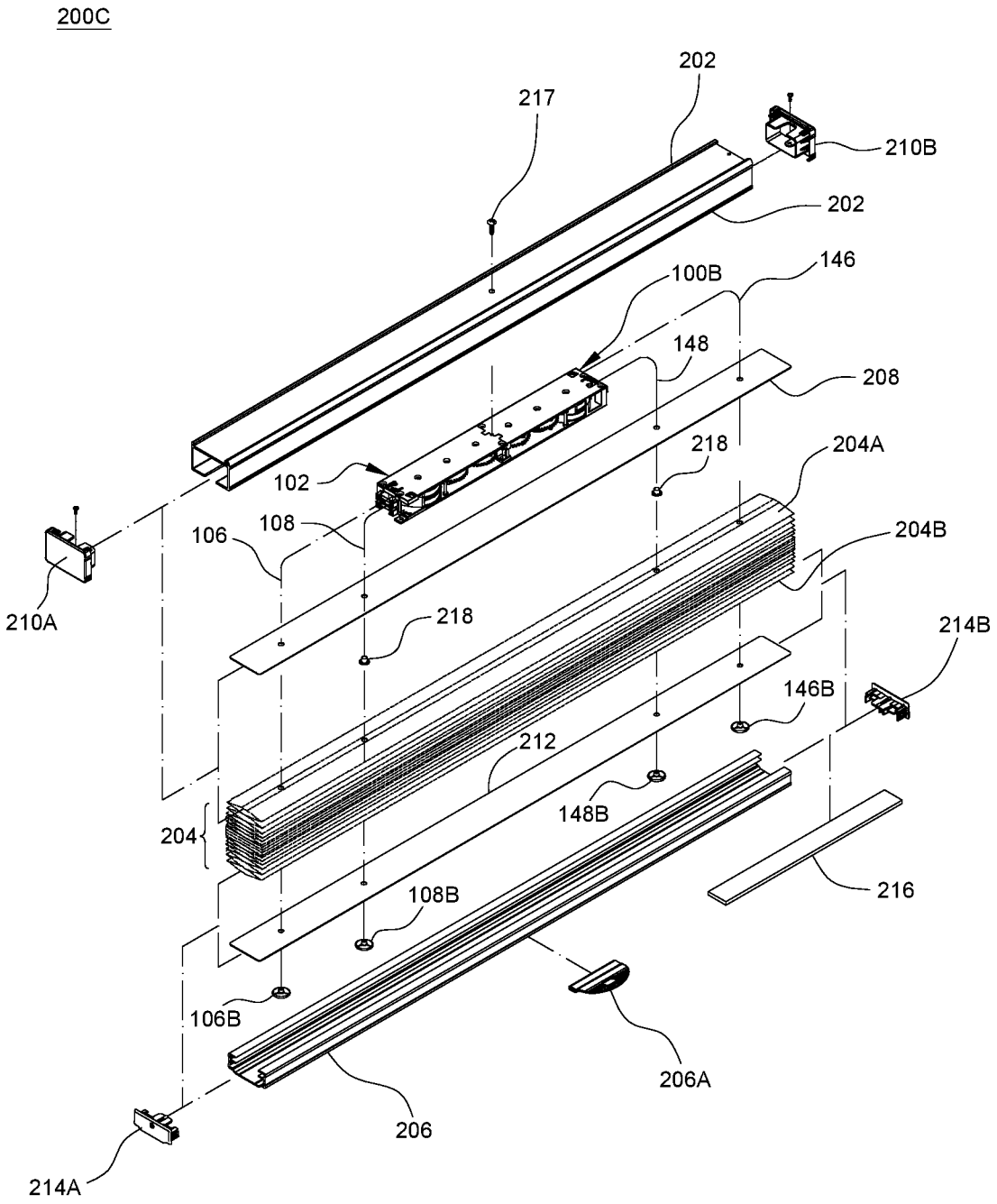
FIG. 21 is an exploded view illustrating an embodiment of a window shade incorporating the spring drive system shown in FIG. 20.

In conjunction with FIGS. 19 and 20, FIG. 21 is an exploded view illustrating a window shade 200C incorporating the spring drive system 100B. Referring to FIGS. 19-21, the window shade 200C can have a construction generally similar to that of the window shade 200 previously described, including the head rail 202, the shading structure 204 and the bottom part 206. The housing 102 of the spring drive system 100B can be affixed to the head rail 202, and the suspension cords 106, 108, 146 and 148 can have respective distal ends 106B, 108B, 146B and 148B affixed to the bottom part 206. More specifically, the two suspension cords 106 and 108 exiting the housing 102 at the end 102A thereof can be affixed to the bottom part 206 at one of a left and right side, and the two suspension cords 146 and 148 exiting the housing 102 at the opposite end 102B thereof can be affixed to the bottom part 206 at the other one of the left and right side. It would be appreciated that the housing 102 of the spring drive system 100B may be alternatively affixed to the bottom part 206, and the suspension cords 106, 108, 146 and 148 may have respective distal ends 106B, 108B, 146B and 148B affixed to the head rail 202.

In the window shade 200C, the two assemblies 142A and 142B of the spring drive system 100B can operate concurrently when the bottom part 206 moves downward or upward relative to the head rail 202, like previously described. Moreover, the springs 112, 114, 152 and 154 of the spring drive system 100B are operable to counteract a weight applied on the bottom part 206 for sustaining the bottom part 206 stationary at any desirable position relative to the head rail 202.

The spring drive systems described herein are relatively simple in construction, have a compact size, and can be conveniently expanded or adapted according to the type or size of a window shade.

Realizations of the structures have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the claims that follow.

What is claimed is:

1. A spring drive system for a window shade, comprising:

a housing;

a first cord drum and a first gear fixedly connected with each other and pivotally connected with the housing, the first cord drum being respectively connected with a first and a second suspension cord;

a second gear pivotally connected with the housing;

a first and a second spring reel respectively connected pivotally at two opposite sides of the second gear so that the first and second spring reels are respectively rotatable relative to the second gear, the second gear and the first and second spring reels being disposed in a coaxial manner;

a third gear pivotally connected with the housing and respectively meshed with the first and second gears, the third gear being respectively connected fixedly with a first and a second take-up reel at two opposite sides of the third gear;

a first spring disposed around the first spring reel and having an end anchored with the first take-up reel, and a second spring disposed around the second spring reel and having an end anchored with the second take-up reel, wherein the first and second springs respectively unwind from the first and second spring reels and respectively wind around the first and second take-up reels when the first cord drum rotates for unwinding the first and second suspension cords, and the first and second springs respectively unwind from the first and second take-up reels and respectively wind around the first and second spring reels to urge the first cord drum in rotation for winding the first and second suspension cords;

a second cord drum and a fourth gear fixedly connected with each other and pivotally connected with the housing, the second cord drum being respectively connected with a third and a fourth suspension cord;

a fifth gear pivotally connected with the housing;

a third and a fourth spring reel respectively pivotally connected at two opposite sides of the fifth gear so that the third and fourth spring reels are respectively rotatable relative to the fifth gear, the fifth gear and the third and fourth spring reels being disposed in a coaxial manner;

a sixth gear pivotally connected with the housing and respectively meshed with the fourth and fifth gears, the sixth gear being respectively connected fixedly with a third and a fourth take-up reel at two opposite sides of the sixth gear; and a third spring disposed around the third spring reel and having an end anchored with the third take-up reel, and a fourth spring disposed around the fourth spring reel and having an end anchored with the fourth take-up reel, wherein the third and fourth springs respectively unwind from the third and fourth spring reels and respectively wind around the third and fourth take-up reels when the second cord drum rotates for unwinding the third and fourth suspension cords, and the third and fourth springs respectively unwind from the third and fourth take-up reels and respectively wind around the third and fourth spring reels to urge the second cord drum in rotation for winding the third and fourth suspension cords;

wherein the first and second suspension cords are configured to couple to a bottom part of the window shade, and the third and fourth suspension cords are configured to couple to an intermediate rail of the window shade.

2. The spring drive system according to claim 1, wherein the housing includes a first and a second housing portion fixedly attachable to each other, the first housing portion carrying an assembly of the first cord drum, the first through third gears, the first and second spring reels, the first and second take-up reels and the first and second springs, and the second housing portion carrying an assembly of the second cord drum, the fourth through sixth gears, the third and fourth spring reels, the third and fourth take-up reels and the third and fourth springs.

3. The spring drive system according to claim 1, wherein the first through sixth gears have pivot axes disposed along a same straight line.

4. The spring drive system according to claim 1, wherein the first through third gears form a first gear train, and the fourth through sixth gears form a second gear train operable independently from the first gear train.

5. The spring drive system according to claim 1, wherein the second suspension cord and the third suspension cord exit the housing at a first end thereof, the first suspension cord and the fourth suspension cord exit the housing at a second end thereof opposite to the first end.

6. The spring drive system according to claim 5, wherein the first suspension cord extends past the second through sixth gears and the second cord drum to the second end of the housing.

7. A window shade comprising:

a head rail, a bottom part, and an intermediate rail between the head rail and the bottom part;

a shading structure having a first and a second end respectively disposed adjacent to the intermediate rail and the bottom part; and the spring drive system according to claim 1, the housing of the spring drive system being affixed to the head rail, the first and second suspension cords having ends respectively affixed to the bottom part, and the third and fourth suspension cords having ends respectively affixed to the intermediate rail.

8. The window shade according to claim 7, wherein the third and fourth springs respectively unwind from the third and fourth spring reels and respectively wind around the third and fourth take-up reels when the intermediate rail moves away from the head rail, and the third and fourth springs bias the second cord drum to rotate for winding the third and fourth suspension cords when the intermediate rail moves toward the head rail.

9. A spring drive system for a window shade, comprising:

a housing;

a first cord drum and a first gear fixedly connected with each other and pivotally connected with the housing, the first cord drum being respectively connected with a first and a second suspension cord;

a second gear pivotally connected with the housing;

a first and a second spring reel respectively connected pivotally at two opposite sides of the second gear so that the first and second spring reels are respectively rotatable relative to the second gear, the second gear and the first and second spring reels being disposed in a coaxial manner;

a third gear pivotally connected with the housing and respectively meshed with the first and second gears, the third gear being respectively connected fixedly with a first and a second take-up reel at two opposite sides of the third gear;

a first spring disposed around the first spring reel and having an end anchored with the first take-up reel, and a second spring disposed around the second spring reel and having an end anchored with the second take-up reel;

a second cord drum and a fourth gear fixedly connected with each other and pivotally connected with the housing, the second cord drum being respectively connected with a third and a fourth suspension cord, wherein the second suspension cord and the third suspension cord exit the housing at a first end thereof, the first suspension cord and the fourth suspension cord exit the housing at a second end thereof opposite to the first end;

a fifth gear pivotally connected with the housing;

a third and a fourth spring reel respectively pivotally connected at two opposite sides of the fifth gear so that the third and fourth spring reels are respectively rotatable relative to the fifth gear, the fifth gear and the third and fourth spring reels being disposed in a coaxial manner;

a sixth gear pivotally connected with the housing and respectively meshed with the fourth and fifth gears, the sixth gear being respectively connected fixedly with a third and a fourth take-up reel at two opposite sides of the sixth gear; and a third spring disposed around the third spring reel and having an end anchored with the third take-up reel, and a fourth spring disposed around the fourth spring reel and having an end anchored with the fourth take-up reel;

wherein the first and second springs respectively unwind from the first and second spring reels and respectively wind around the first and second take-up reels when the first cord drum rotates for unwinding the first and second suspension cords, and the first and second springs respectively unwind from the first and second take-up reels and respectively wind around the first and second spring reels to urge the first cord drum in rotation for winding the first and second suspension cords; and wherein the third and fourth springs respectively unwind from the third and fourth spring reels and respectively wind around the third and fourth take-up reels when the second cord drum rotates for unwinding the third and fourth suspension cords, and the third and fourth springs respectively unwind from the third and fourth take-up reels and respectively wind around the third and fourth spring reels to urge the second cord drum in rotation for winding the third and fourth suspension cords.

10. The spring drive system according to claim 9, wherein the housing includes a first and a second housing portion fixedly attachable to each other, the first housing portion carrying an assembly of the cord drum, the first through third gears, the first and second spring reels, the first and second take-up reels and the first and second springs, and the second housing portion carrying an assembly of the second cord drum, the fourth through sixth gears, the third and fourth spring reels, the third and fourth take-up reels and the third and fourth springs.

11. The spring drive system according to claim 9, wherein the first through sixth gears have pivot axes disposed along a same straight line.

12. The spring drive system according to claim 9, wherein the first through third gears form a first gear train, and the fourth through sixth gears form a second gear train operable independently from the first gear train.

13. The spring drive system according to claim 9, wherein the first suspension cord extends past the second through sixth gears and the second cord drum to the second end of the housing.

14. A window shade comprising:

a head rail, a bottom part, and an intermediate rail between the head rail and the bottom part;

a shading structure having a first and a second end respectively disposed adjacent to the intermediate rail and the bottom part; and the spring drive system according to claim 9, wherein the housing of the spring drive system is affixed to the head rail, the first and second suspension cords have ends respectively affixed to the bottom part, and the third and fourth suspension cords have ends respectively affixed to the intermediate rail.

15. The window shade according to claim 14, wherein the third and fourth springs respectively unwind from the third and fourth spring reels and respectively wind around the third and fourth take-up reels when the intermediate rail moves away from the head rail, and the third and fourth springs bias the second cord drum to rotate for winding the third and fourth suspension cords when the intermediate rail moves toward the head rail.

* * * * *